US007101326B2

(12) United States Patent
Gerschefske et al.

(10) Patent No.: US 7,101,326 B2
(45) **Date of Patent: *Sep. 5, 2006**

(54) STORABLE EXERCISE APPARATUS FOR PROFESSIONAL AND HOME USE

(75) Inventors: Kevin Gerschefske, Springfield, MO (US); Juliu Horvath, New York, NY (US); San-Ping Lee, Nun-Tou Hsien (TW); Marjolein Brugman, Cambridge, MA (US)

(73) Assignee: Stamina Products, Inc., Springfield, MO (US)

( * ) Notice: Subject to any disclaimer, the term of this patent is extended or adjusted under 35 U.S.C. 154(b) by 153 days.

This patent is subject to a terminal disclaimer.

(21) Appl. No.: 10/743,255

(22) Filed: Dec. 23, 2003

(65) Prior Publication Data

US 2004/0214697 A1 Oct. 28, 2004

Related U.S. Application Data

(63) Continuation of application No. 09/910,942, filed on Jul. 24, 2001, now Pat. No. 6,669,609.

(30) Foreign Application Priority Data

Jan. 18, 2001 (TW) ..... 90201007 U

(51) Int. Cl.
*A63B 21/04* (2006.01)
*A63B 21/055* (2006.01)

(52) U.S. Cl. ..... 482/129; 482/130; 482/138; 482/142

(58) Field of Classification Search ..... 482/92, 482/121–123, 125, 126, 129, 130, 133, 138, 482/142, 102, 103, 127; D21/693, 690, 676
See application file for complete search history.

(56) References Cited

U.S. PATENT DOCUMENTS 679,784 A 8/1901 Ryan
2,267,376 A 12/1941 Malm
3,501,140 A * 3/1970 Eichorn ..... 482/130

(Continued)

FOREIGN PATENT DOCUMENTS

CH 577327 A * 7/1976

(Continued)

OTHER PUBLICATIONS

Wendy Marston, "Grace Under Pressure," *Newsweek*, Sep. 11, 2000, pp. 78-79.

(Continued)

*Primary Examiner*—Gregory L. Huson
*Assistant Examiner*—Victor K. Hwang
(74) *Attorney, Agent, or Firm*—Pillsbury Winthrop Shaw Pittman, LLP

(57) ABSTRACT

A storable exercise apparatus for home use. The apparatus includes an upright tower, a base structure, a bench frame, and a bench attached to the bench frame. A set of flexible pull lines coupled to a resilient spring system are carried within the tower structure. The user exercises by pulling the pull lines against the bias of the spring system. The grips for the pull lines are mounted at the top of the tower and generate significant tipping force on the tower when the apparatus is in use. To prevent tipping, the bench frame has pivotal and load-transmitting connections with the tower structure; the tower is stabilized by the weight of the user on the bench. The bench may be placed in either a raised or lowered position, and can be stored by collapsing and pivoting it so that it abuts the tower vertically.

2 Claims, 27 Drawing Sheets

U.S. PATENT DOCUMENTS 3,709,487 A * 1/1973 Walker ..... 482/133
3,851,874 A * 12/1974 Wilkin ..... 482/92
4,257,590 A 3/1981 Sullivan et al.
4,369,966 A 1/1983 Silberman et al.
4,634,127 A 1/1987 Rockwell
4,635,926 A 1/1987 Minkow
4,691,918 A 9/1987 Rockwell
4,718,659 A * 1/1988 Hayashi ..... 482/130
4,721,303 A * 1/1988 Fitzpatrick ..... 482/103
4,747,594 A 5/1988 Houde
4,804,179 A 2/1989 Murphy
4,811,946 A 3/1989 Pelczar
4,826,157 A 5/1989 Fitzpatrick
4,830,363 A 5/1989 Kennedy
4,850,586 A 7/1989 Horvath
4,907,798 A 3/1990 Burchatz
4,921,242 A 5/1990 Watterson
5,090,694 A 2/1992 Pauls et al.
5,141,480 A 8/1992 Lennox et al.
5,263,916 A * 11/1993 Bobich ..... 482/124
5,324,243 A 6/1994 Wilkinson
5,328,428 A 7/1994 Huang
5,403,253 A 4/1995 Gaylord
5,403,257 A 4/1995 Lehtonen
5,419,749 A 5/1995 Morgenstein
5,431,617 A 7/1995 Rattray, Jr.
5,468,205 A 11/1995 McFall et al.
5,487,714 A 1/1996 Ferrari
5,522,784 A 6/1996 Grant
5,674,167 A 10/1997 Piaget et al.
5,842,961 A 12/1998 Davis
5,941,807 A * 8/1999 Cassidy et al. ..... 482/146
6,015,369 A 1/2000 Rasmussen
6,142,919 A 11/2000 Jorgensen
6,159,133 A 12/2000 Shugg
6,228,004 B1 5/2001 Steinbach et al.
6,585,626 B1 * 7/2003 McBride ..... 482/130
6,595,905 B1 * 7/2003 McBride ..... 482/130
6,669,609 B1 * 12/2003 Gerschefske et al. ..... 482/123

FOREIGN PATENT DOCUMENTS

EP 507509 10/1992
FR 2234017 1/1975
GB 2 257 921 A 1/1993

OTHER PUBLICATIONS

"Gyrolonic Expansion System" videotape.
"Bowflex Motivator: Owner's Manual & Fitness Guide," Bowflex, Inc., 1997
"Bowflex Ultimate: Owner's Manual & Fitness Guide," Bowflex, Inc., 2001.
"Bowflex Power Pro: Owner's Manual & Fitness Guide," Bowflex, Inc., 1997.

* cited by examiner

STORABLE EXERCISE APPARATUS FOR PROFESSIONAL AND HOME USE

CROSS REFERENCES TO RELATED APPLICATIONS

This application is a continuation of U.S. patent application Ser. No. 09/910,942, filed Jul. 24, 2001, now U.S. Pat. No. 6,669,609 which in turn claims priority from Taiwanese patent application 90201007, filed on Jan. 18, 2001, the contents of which are hereby incorporated by reference herein in their entirety.

BACKGROUND OF THE INVENTION

1. Field of the Invention

The present invention relates generally to exercise equipment for home use, and more particularly to home use exercise equipment allowing exercise motions in substantially any plane of motion.

2. Description of Related Art

Recently, there has been considerable emphasis on marketing exercise equipment that allows for an integrated approach to fitness. Such integrated exercise equipment allows a user to exercise multiple muscle groups using the same piece of equipment, and may support toning and range-of-motion exercises, rather than traditional strengthening or muscle building.

In particular, a type of exercise based upon a combination of yoga and dance movements has become popular. This type of exercise focuses almost entirely on a user's muscle tone and range-of-motion, emphasizing circular movements of the body and limbs during exercise. A variety of specialized exercise equipment has been developed to support these types of circular, free-form exercise movements. U.S. Pat. No. 4,850,586 to Horvath, for example, discloses an exercise apparatus that has resistive rotors as a primary component. These rotors provide resistance for circular movements in a variety of planes.

The apparatus of Horvath has been developed for professional environments, such as gyms and exercise studios. In professional settings, the Horvath apparatus typically includes a tower structure having a directional pulley system that allows the user to exert force against the resistive elements in the tower in arbitrary planes of motion. When a tower is used, the bench and rotor assembly of U.S. Pat. No. 4,850,586 is spaced some distance away from the tower while the user performs exercises. The force exerted by the user against the resistive elements in the tower tends to tip the tower in a forward direction, toward the user and the bench. This tipping force can be significant, as resistive elements or directional pulleys are often placed at the top of the tower and the bench is usually spaced at a relatively large distance from the tower.

The tower and bench are typically prevented from tipping by placing heavy counterweights to oppose the tipping force, or by providing the tower structure with large, heavy feet which add stability. Additionally, the tower usually uses free weights as resistive elements, and the weight provided by these free weights increases the stability of the tower.

The need to provide such a large, heavy tower in order to ensure stability has hindered efforts to successfully market the Horvath apparatus, which has thus far been used only by very specialized exercise studios. While a large, heavy piece of equipment may be acceptable for very specialized studios, which typically focus their business on that piece of equipment, such equipment is usually unacceptable to less specialized exercise studios and gyms, which must accommodate a variety of exercise equipment.

Additionally, people are most inclined to engage in a particular type of exercise if a version of the necessary exercise apparatus is available for home use. Typically, home use exercise equipment must be designed so that it is lightweight and storable, since the home user may not have a dedicated area for fitness, and may need to move the equipment and store it between exercise sessions. The size and weight of the typical Horvath apparatus precludes the average home user from owning one, because it is not especially portable and is relatively difficult to store.

Therefore, a relatively lightweight, storable version of the Horvath apparatus is needed. Such an apparatus would allow the Horvath exercise method and apparatus to reach nearly untapped consumer markets.

SUMMARY OF THE INVENTION

The present invention is a lightweight, portable exerciser. The exerciser comprises a frame assembly including a base structure and an upright structure fixed to the base structure and extending upwardly therefrom. The base structure has downwardly facing surfaces for engaging an upwardly facing surface to support the frame structure thereon. The base structure extends forwardly of the upright structure so that the upright structure cannot be tipped over forwardly except by the entire frame being tipped forwardly about the forward end of the base acting as a fulcrum.

The upright structure includes a pair of flexible exercising pull lines carried by the upright structure at an upper end portion thereof so as to extend downwardly and forwardly therefrom. Each of the pull lines has interconnecting structures configured to be interconnected by a user either with the user's hands or the user's feet.

The upright structure also carries an extensible and retractable spring system. The spring system is operatively connected to the pull lines so as to resiliently resist movement of the pull lines in a direction downwardly and forwardly from the upper end portion of the upright structure.

The exerciser also includes a bench assembly configured and positioned to support a user in a prone, supine or sitting position thereon so as to enable the user so positioned to interconnect with said user interconnecting structure and pull said pull lines downwardly and forwardly against the resilient resistance of the spring system. The resistance provided by the spring system provides the user with exercise while creating a force on the upper end portion of the upright structure. The force tends to tip the upright structure forwardly about the fulcrum provided by the forward end of the base structure.

The bench assembly includes a bench frame and a bench pad mounted on the bench frame for movement between a raised operative user supporting position spaced above the bench frame and a lowered operative position disposed adjacent to the bench frame. The bench frame includes an inner end portion which has a load transmitting connection with the base structure and an outer end portion extending forwardly beyond the forward end of the base structure. The outer end portion has downwardly facing surfaces for engaging the upwardly facing horizontal surface engaged by the downwardly facing surfaces of the base structure.

The load transmitting connection between the bench frame and the base structure is partitioned when the bench pad is within the raised or lowered operative position thereof so as to transmit a portion of the load defined by the weight of a user supported on the bench pad to the base structure at a position spaced inwardly of the forward end to provide additional tipping resistance. The load transmitting connection is also constructed and arranged to allow the bench frame and bench pad, when the lowered position, to be moved into a connected storage position wherein the bench pad and bench frame are upright alongside the upright structure.

Another aspect of the present invention is embodied in an exerciser having the features described above but without a load-transmitting connection between the bench frame and the base structure.

BRIEF DESCRIPTION OF THE DRAWINGS

The above and other objects, features and advantages of the present invention are further described in the detailed description which follows, with reference to the drawings, and by way of non-limiting exemplary embodiments of the present invention, wherein like reference numerals represent similar parts of the present invention throughout the several views and wherein.

DETAILED DESCRIPTION

Figure 1:
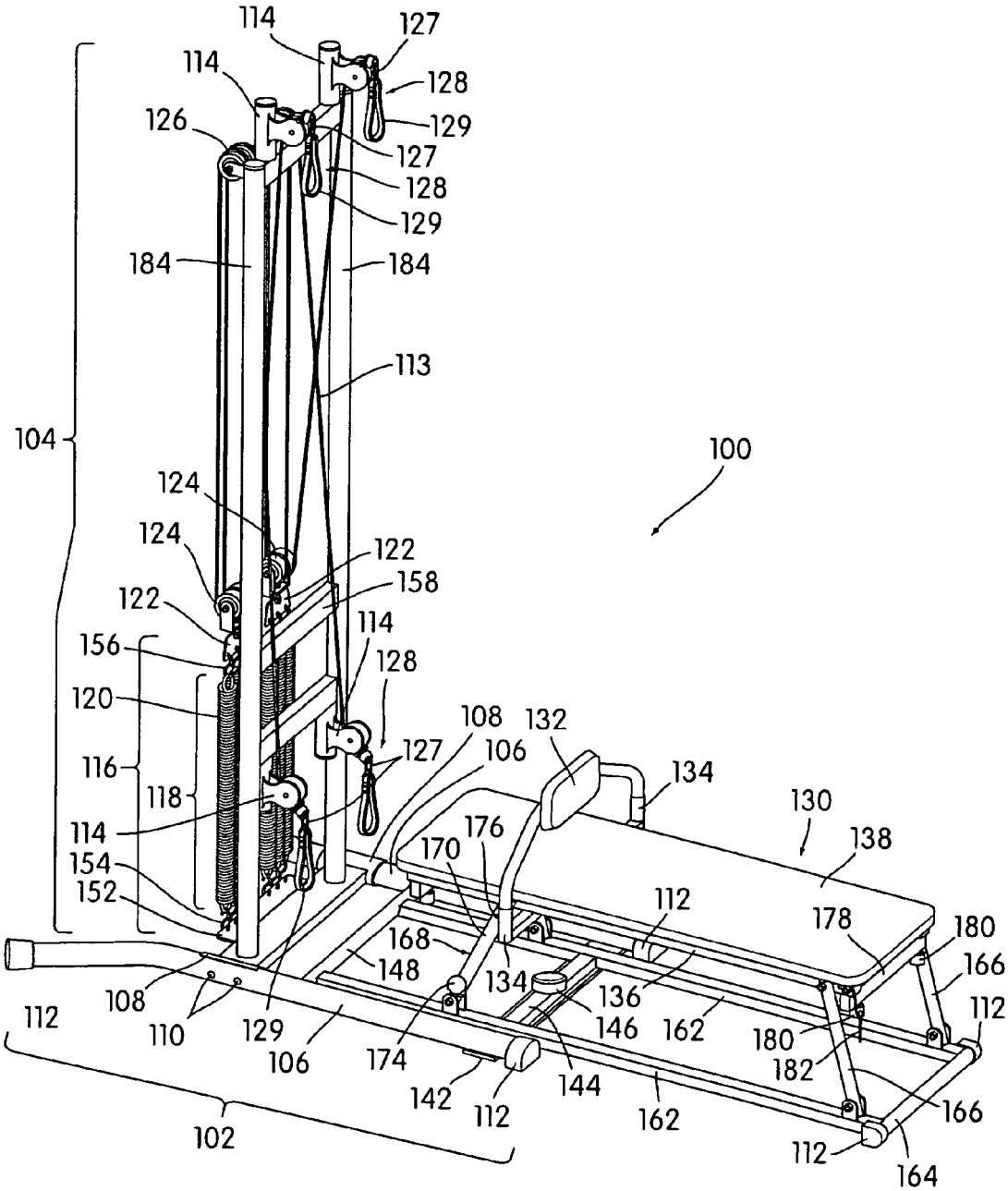
FIG. 1 is a perspective view of a first embodiment of an exercise apparatus according to the present invention.

Referring now more particularly to the drawings, FIG. 1 shows an exercise apparatus according to a first embodiment of the present invention, generally indicated at 100. The exercise apparatus 100 includes a frame assembly having a base structure 102 and an upright structure 104 fixed to the base structure 102. The upright structure, or tower 104, extends upwardly from the base structure 102.

Two elongate, hollow tubular members 106 serve as the major component of the base structure 102, connecting with the tower 104 at contoured contact surfaces 108 provided at the bottom of the tower 104. The tubular members 106 are fixedly secured to the tower 104 by means of bolts 110 inserted through the tubular members 106 and contact surfaces 108. The tubular members 106 extend outwardly to the rear of the tower 104 and in parallel forward of the tower 104. The outward extension of the tubular members 106 behind the tower 104 provides the apparatus 100 with better stability. In general, the base structure 102 extends forwardly of the tower 104 such that the apparatus 100 cannot be tipped over forwardly except by the entire apparatus 100 being tipped forwardly about the forward end of the base structure 102 (i.e., tipped about the forward ends of the tubular members 106). Each tubular member 106 is provided with rubberized endcaps 112 to prevent slipping on smooth or polished floor surfaces.

The tower 104 includes a set of flexible exercising pull lines 113, the pull lines 113 directed by swiveling directional pulley assemblies 114 to extend downwardly and forwardly from the tower 104 when in use. The pull lines 113 terminate in user interconnect, or grip, assemblies 128. The grip assemblies 128 in this embodiment include a set of nested nylon loops 129 connected to the pull lines 113 by means of metal rings 127. The grip assemblies 128 are suitable for either a user's hands or feet.

The pull lines 113 are coupled to a retractable spring system, generally indicated at 116. The spring system 116 is comprised of two identical spring sub-assemblies 118. Each sub-assembly 118 is comprised of three springs 120 connected to a connecting plate 122. In each sub-assembly 118, pull lines 113 run between a first pulley set 124 connected to the connecting plate 122 and a second pulley set 126 proximate to the top of the tower 104 before running into the directional pulley assemblies 114. The structure and function of the spring system 116 will be further described below.

In this embodiment, a lower set of directional pulleys 114 and a lower set of grip assemblies 128 are provided on a lower portion of the tower 104. The first and second pulley sets 124, 126 of this embodiment are double pulley sets, and the pull lines 113 and pulley sets 124, 126 are constructed and arranged such that each spring sub-assembly 118 provides resistance for an upper and a lower set of grip assemblies 128 (e.g., the left-side spring sub-assembly provides resistance for the left-side upper and left-side lower grip assemblies 128).

The apparatus 100 also includes a bench assembly, generally indicated at 130, configured and positioned to support a user in a prone, supine or sitting position so as to enable the user to use the grips 128 to pull the pull lines 113. The bench assembly 130 includes a bench 136 and bench pad 138 connected to a bench frame 178, 166, 168, 172. The bench 136 is moveable between a raised operative user supporting position and a lowered operative position in which the bench pad 138 and bench 136 are disposed adjacent to the bench frame 178, 166, 168, 172. In FIG. 1, a removable chest and back support 132 for supporting a user in sitting positions is also shown. The removable chest and back support 132 is connected to the bench frame by means of two receptacles 134, one receptacle extending from the bench frame 140 on either side of the bench 136.

The bench assembly 130 has a load transmitting connection to the base structure 102. This load transmitting connection allows the weight of a user to be transmitted to the tubular members 106, thus stabilizing the tower and preventing the tower 104 from tipping forward when the exercise apparatus is in use. The load transmitting connection is formed by a crossbrace 142 that connects the forward portion of the two tubular members 106 with a corresponding crossmember 144 of the bench assembly 130. The crossbrace 142 has a threaded hole 186 formed through its center, and a corresponding hole is formed in the corresponding crossmember 144. A threaded rod 146 having a user manipulable knob attached to one end forms a rigid, removable connection between the crossbrace 142 and the crossmember 144, and thus, between the bench assembly 130 and the tubular members 106 of the tower structure 104.

The bench assembly 130 is constructed and arranged to be moved into a connected storage position with respect to the tower 104 when not in use. The movement of the bench assembly 130 into this connected storage position is facilitated by a pivotal connection between the two tubular members 106 of the base structure 102 and the bench assembly 130 at a pivot-crossbrace 148. The connected storage position will be described below.

Figure 2:
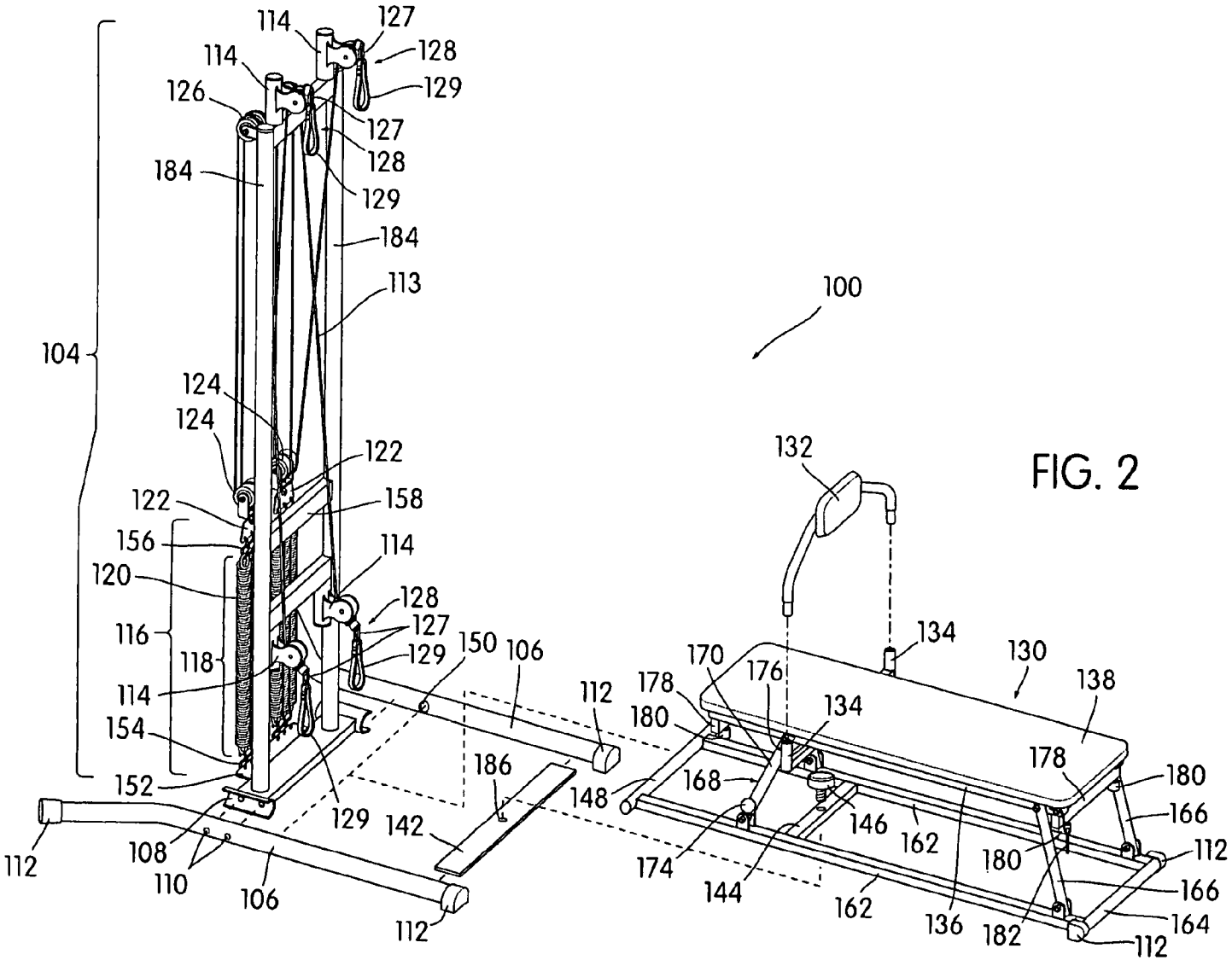
FIG. 2 is an exploded perspective view of the exercise apparatus of FIG. 1, showing the assembly of various components thereof.

FIG. 2 is an exploded perspective view of the exercise apparatus 100. Preferably, the apparatus 100 is constructed and arranged to be disassembled and reassembled to facilitate manufacturing and shipping processes. FIG. 2 presents one exemplary way in which the exercise apparatus 100 may be disassembled for shipping. In FIG. 2, the tubular members 106 have been disconnected from the tower structure 104, allowing the bench assembly 130 to be removed. The bench 130 can then be collapsed, and the disconnected structures 104, 106, 130, 142 shipped in a relatively compact and flat shipping container. FIG. 2 also illustrates the connection between the tower 104 and the tubular members 106; in particular, the hole 150 is provided in the inwardly-facing surface of each of the tubular members 106 to accommodate the pivot-crossbrace 148 when the exercise apparatus 100 is assembled.

Figure 3:
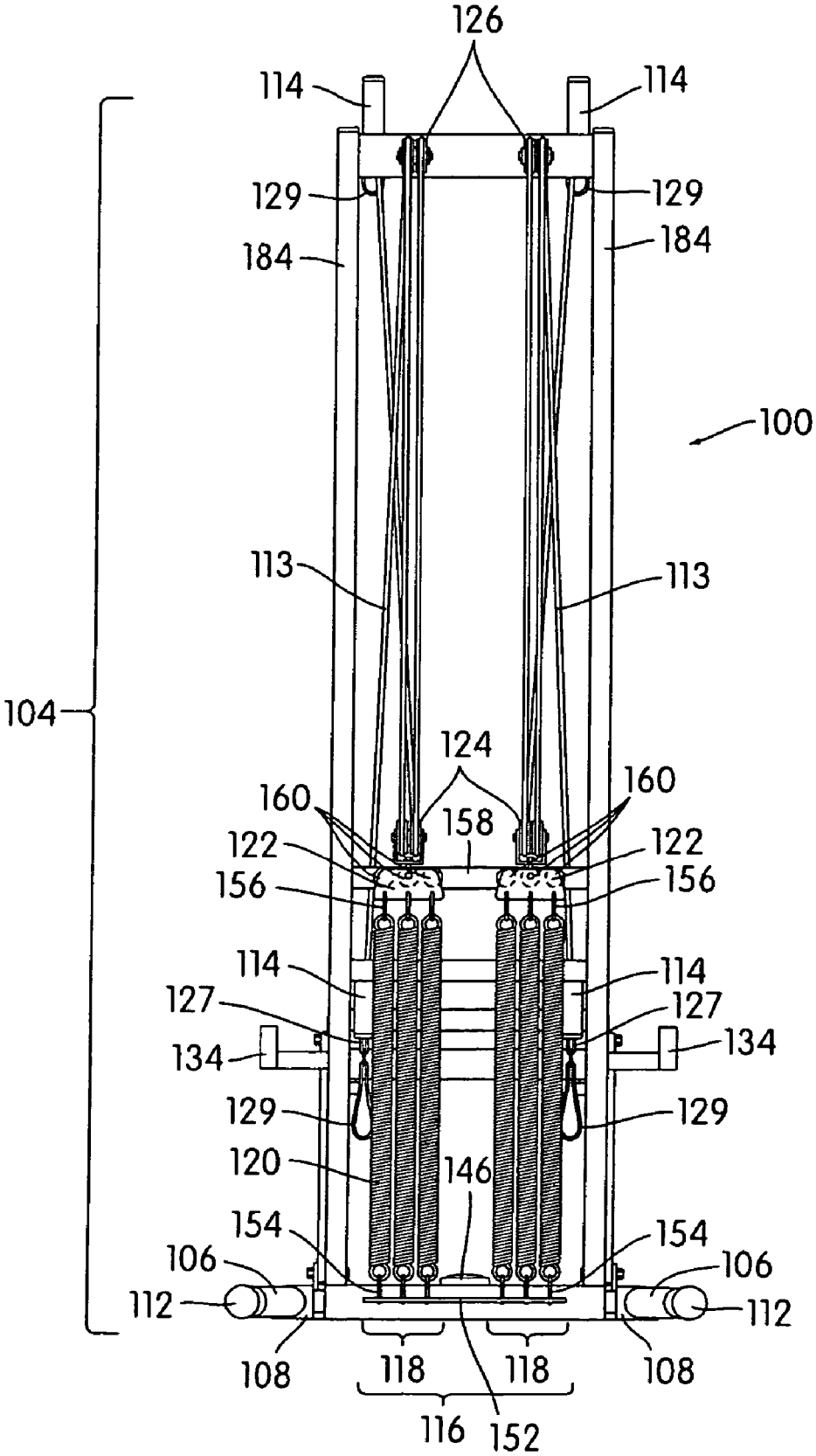
FIG. 3 is a rear elevational view of the exercise apparatus of FIG. 1.

FIG. 3 is a rear elevational view of the assembled exercise apparatus 100 with the bench assembly 130 in the raised operative user supporting position. The spring system 116 and each of its two sub-assemblies 118 are shown in this figure. In this embodiment, each spring 120 is a metallic tension spring with a full loop at each end. However, it is contemplated that the function of the springs 120 may be performed by an elastomeric strap, an elastic cord or any other elastic, extensible, resilient member. The springs 120 are attached with S-hooks 154 at their lower ends to a flange 152 welded to a lower portion of the tower 104 and by S-hooks 156 at their upper ends to the connecting plates 122. The connecting plates 122 are pivotally connected to the first pulley sets 124 by pivoting bolted connections.

In the exercise apparatus 100, several pegs 160 are fixedly mounted to a tower crossmember 158, which is fixed to the tower 104 at approximately the level of the tops of the springs 120. The resistive force provided by each of the spring sub-assemblies 118 can be adjusted by detaching one or more of the springs 120 from the S-hooks 156 that connect them to the connecting plate 122. Springs 120 that are detached from the connecting plate 122 can be temporarily stored by placing the end of the spring on one of the pegs 160. Preferably, the user removes only the center spring 120 from the each connecting plate 122 so that the connecting plate 122 remains balanced, but because the connecting plate 122 is pivotally mounted for rotation about an axis defined by the bolted connection, a user may remove either one or two springs from each of the spring sub-assemblies 118 and continue to use the apparatus 100 with a commensurately reduced amount of resistance. Alternately, a user may choose to reduce or increase the resistance provided by only one of the spring sub-assemblies 118, for instance, to compensate for a strength imbalance in the limbs or an injury to a particular limb.

The exercise apparatus 100 uses a total of two pull lines 113; a single pull line runs from each spring sub-assembly 118 to the upper and lower grip assemblies 128 served by that assembly. One end of the pull line 113 is attached to the grip structure 128 and the upper directional pulley 114. From the upper directional pulley 114, the pull line extends through the first pulley set 124, and from the first pulley set 124 to the second pulley set 126. The pull line 113 then extends from the second pulley set 126 to the lower directional pulley 114, terminating at the grip assemblies 128. The arrangement of the first and second pulley sets 124, 126 and the pull lines 113 allows the user to use both the upper and lower grip assemblies 128 that are attached to the same spring sub-assembly simultaneously. The arrangement of the pulleys 124, 126 and pull lines 113 also provides the user with a significant mechanical advantage against the resistive bias of the spring sub-assemblies; therefore, relatively stiff springs (i.e., springs having a large spring constant) may be used to provide adequate resistance for some exercises.

Figure 4:
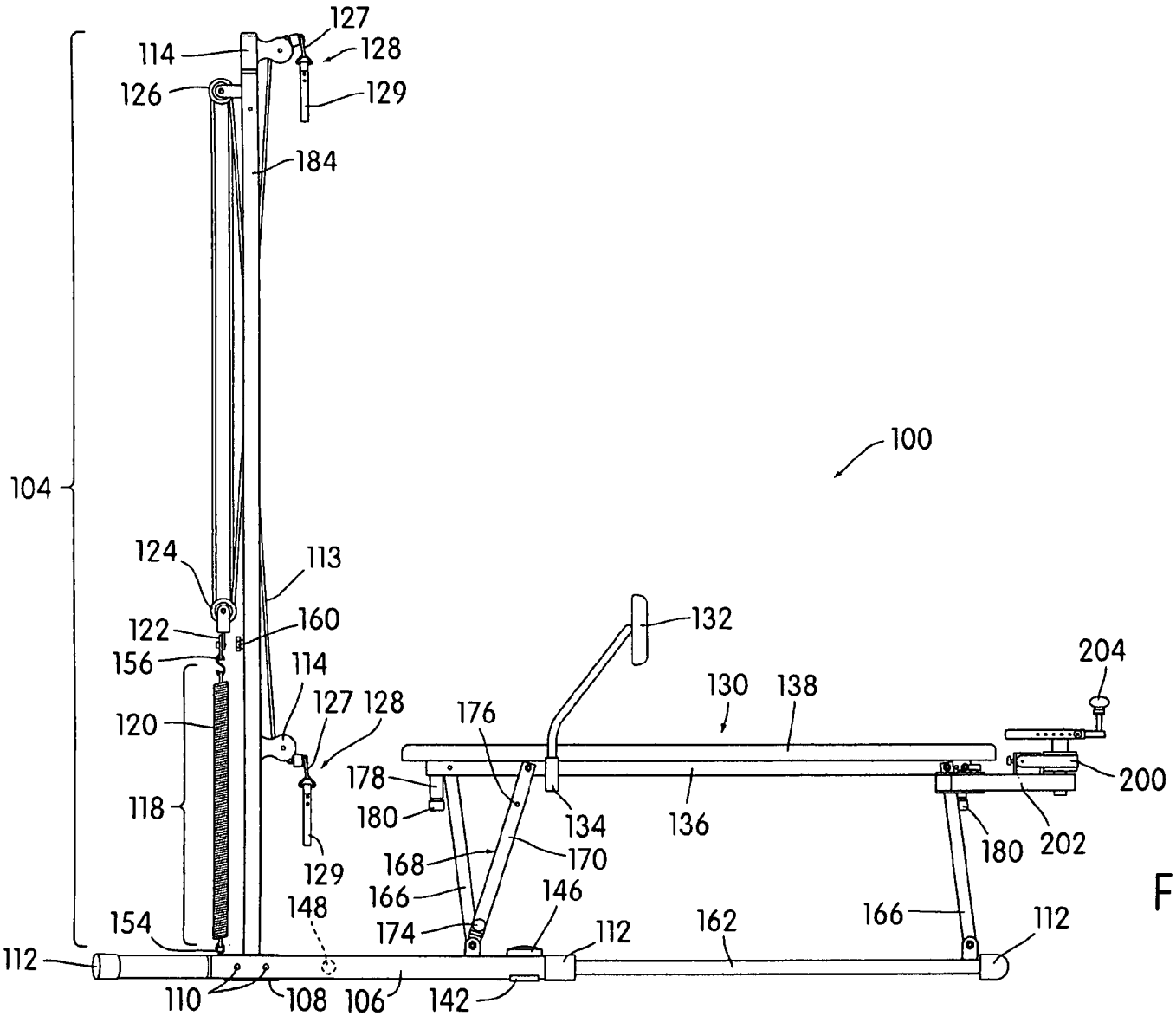
FIG. 4 is a side elevational view of the exercise apparatus of FIG. 1 in the raised operative position.

Referring to FIG. 4, the apparatus 100 may include exercise rotor assemblies 200 as disclosed in U.S. Pat. No. 4,850,586 to Juliu Horvath and Taiwanese patent application No. 90201007, both of which were incorporated by reference above. These rotor assemblies 200 are constructed so as to be removably attached to the bench assembly 130 at the rectangular member 178. In this embodiment, the rectangular member 178 is a hollow tubular member, and the terminus of the rotor assembly's connecting arm 202 may be inserted therein to form an interference fit, thus securing the rotor assemblies 200 to the bench assembly 130. If the rotor assemblies 200 are not attached to the bench assembly 130, the rectangular member 178 may be provided with plastic or rubber endcaps.

As is shown in FIGS. 1 and 2, the bench assembly 130 includes two generally parallel floor-contact members 162 that extend from the pivot-crossbrace 148 to the end cross-piece 164, forming a rigid, rectangular frame in contact with the floor. Three legs 166 are pivotally connected between the floor-contact members 162 and the bench 136.

The arrangement of the legs 166 is better illustrated in FIG. 4, a side elevational view of the apparatus 100 with the bench 136 in the raised operative position. Two of the legs 166 are shown in FIG. 4. The bench assembly 130 also includes an extendable and retractable fourth leg 168 which is used as a locking mechanism to retain the bench assembly 130 in the upper and lower operative positions, respectively. The fourth leg 168 is pivotally connected between one of the floor contact members 162 and the bench 136, and is positioned so as to be the same length as the other three legs 166 in the raised operative position. However, as is shown in FIG. 4, the fourth leg 168 is attached to the floor contact members 162 and bench 136 at a different angle than the other legs 166. The angular offset of the attachment point of the fourth leg 168 substantially prevents the bench assembly 130 from moving between the raised and lowered operative positions unless the length of the fourth leg 168 is changed.

The fourth leg 168 is comprised of two hollow tubular members, an outer tubular member 170 and an inner tubular member 172 mounted concentrically within the outer member 170. The length of the fourth leg 168 changes when the inner tubular member 172 slides relative to the outer tubular member 170. The fourth leg 168 can be fixed at either a raised-position length or a lowered-position length by inserting a pin 174 through one of two sets of co-linear holes 176 formed through the diameter of the leg 168.

Figure 5:
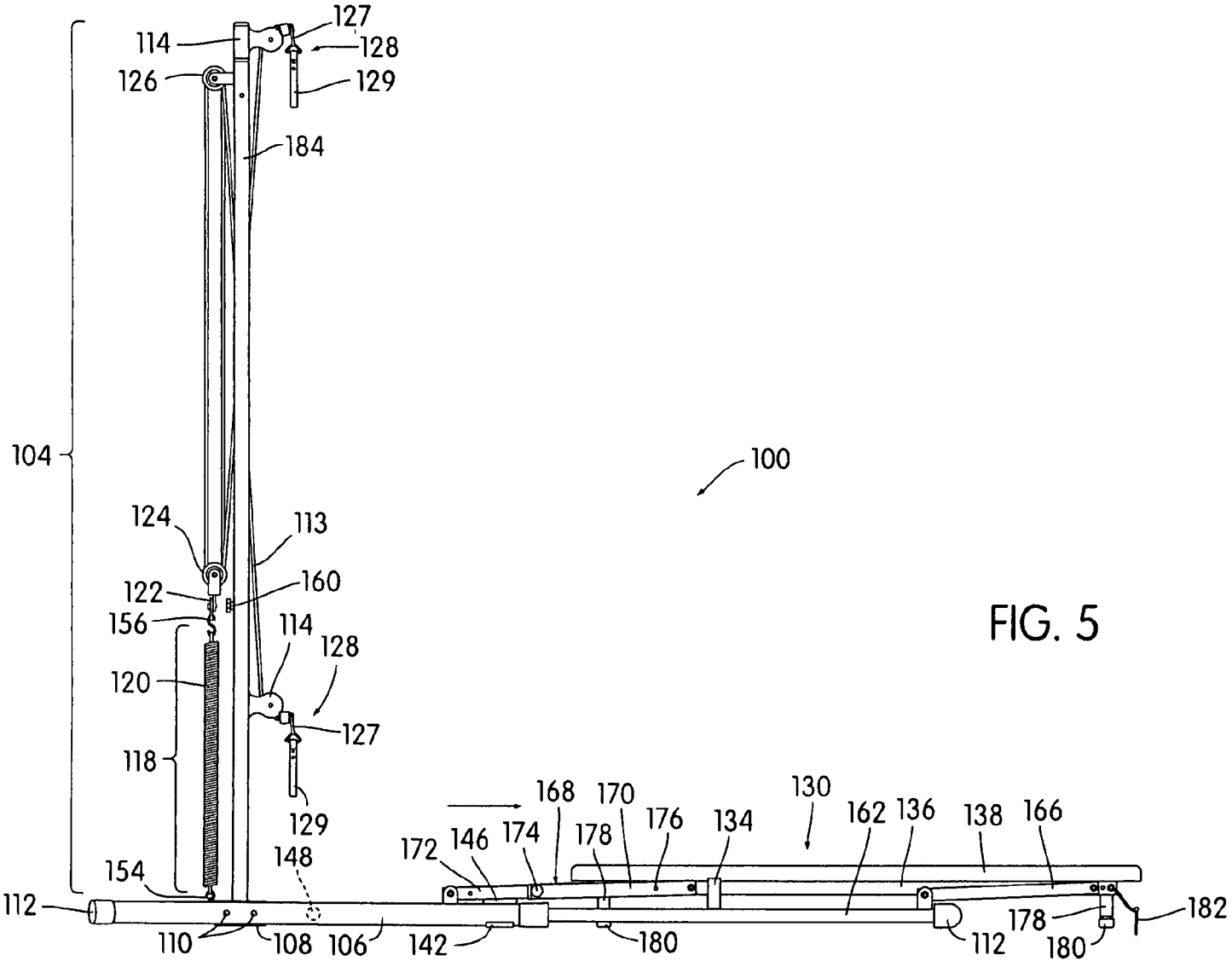
FIG. 5 is a side elevational view of the exercise apparatus of FIG. 1 in lowered operative position.

FIG. 5 illustrates the lowered operative position of the bench assembly 130. To move the bench assembly 130 from the raised operative position to the lower operative position, the user first removes the pin 174 from the fourth leg 168. Next, the user pushes the bench assembly 130 in a forward direction (as indicated by the arrow), causing the fourth leg 168 to extend and the bench 136 to collapse, thus establishing the lower operative position of the bench assembly 130. Finally, the user may secure the bench assembly 130 in the lower operative position by re-inserting the pin 174 into a second set of holes 176 in the fourth leg 168.

Figure 6:
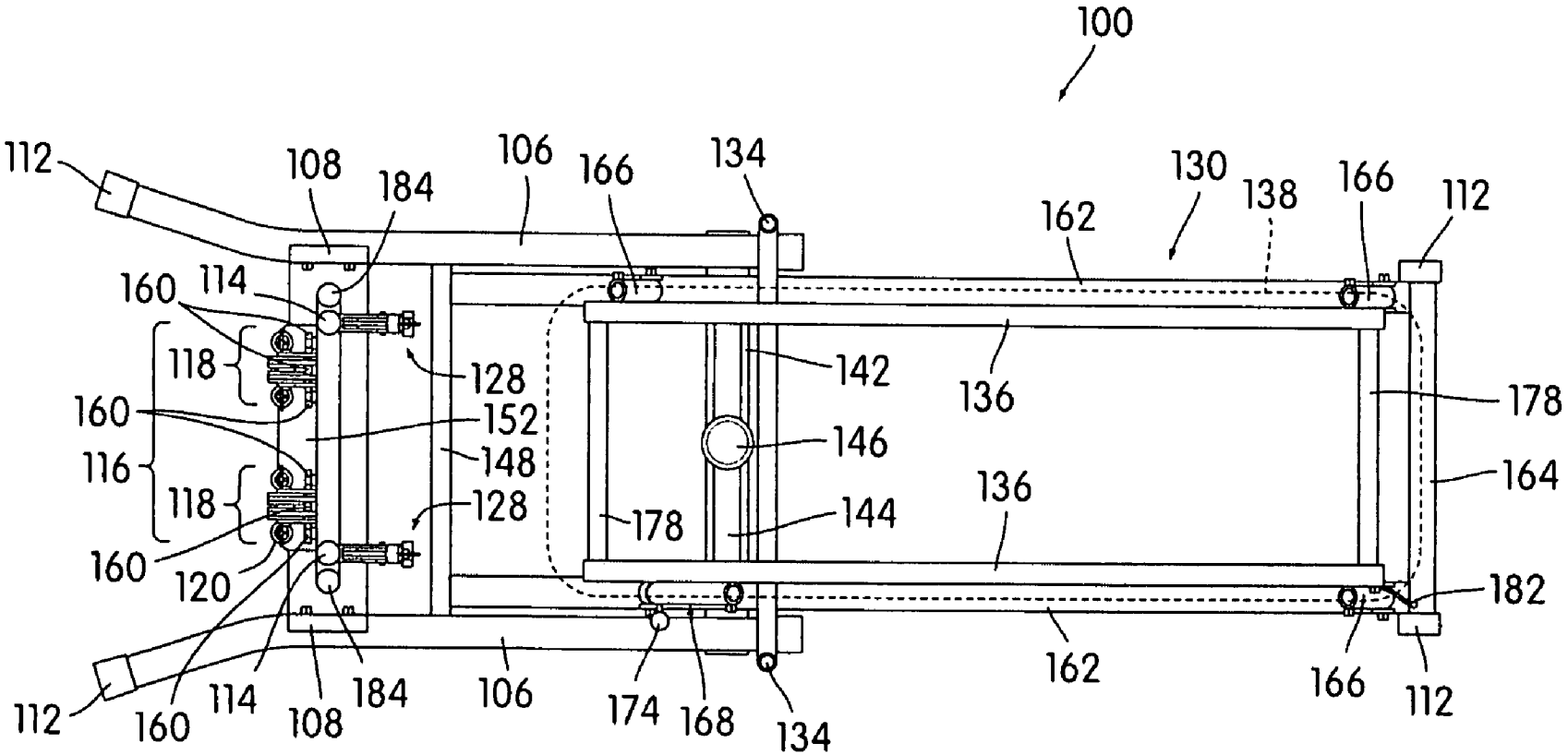
FIG. 6 is a top plan view of the exercise apparatus of FIG. 1 in the raised operative position.
Figure 7:
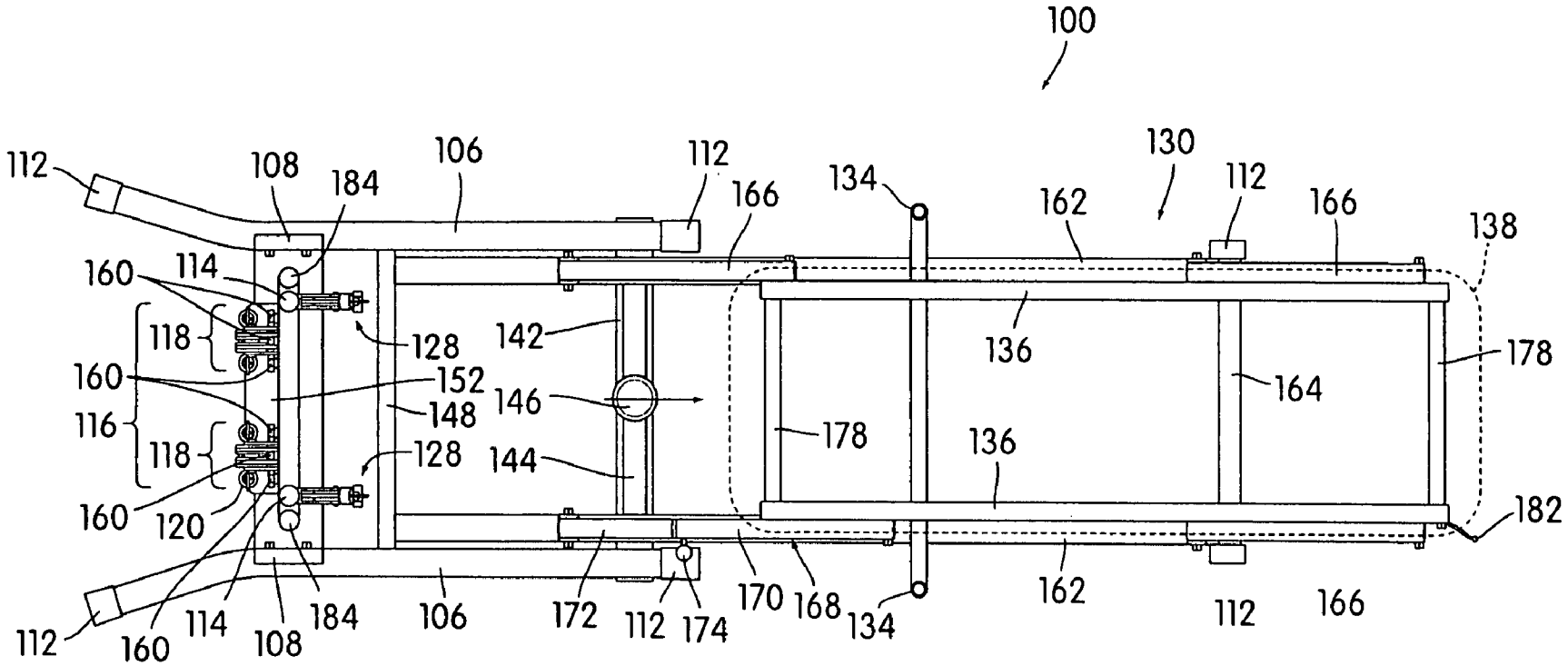
FIG. 7 is a top plan view of the exercise apparatus of FIG. 1 in the lowered operative position.

FIGS. 6 and 7 are top plan views of the apparatus 100 with the bench assembly 130 in the raised operative and lowered operative positions, respectively. The bench 136 is shown in phantom in both views. The angle and position of attachment of the three inextensible legs 166 and the fourth leg 168 are visible in FIG. 6. FIG. 7, in particular, illustrates the extension of the fourth leg 168.

As shown in FIGS. 4, 6, and 7, the bench 136 is supported in the lower operative position by two rectangular members 178 which extend downwardly from the bench 136 at each end. Each of the rectangular members 178 is equipped with a set of rubber feet 180 which contact the floor.

If the exercise apparatus 100 is to be placed in its connected storage position, the user first places the bench assembly 130 in the lower operative position of FIG. 5 and then unscrews the threaded rod 146 that connects the crossbrace 144 of the bench assembly 130 with the corresponding crossmember 142 of the tower. With the pin 174 inserted into the fourth leg 168 to fix the bench assembly in the collapsed position, the user lifts the forward end of the bench assembly 130, thus rotating it about the pivot-crossbrace 148 in a counterclockwise direction until it extends vertically, abutting the tower 104. This position is illustrated in the side elevational view of FIG. 8.

Figure 8:
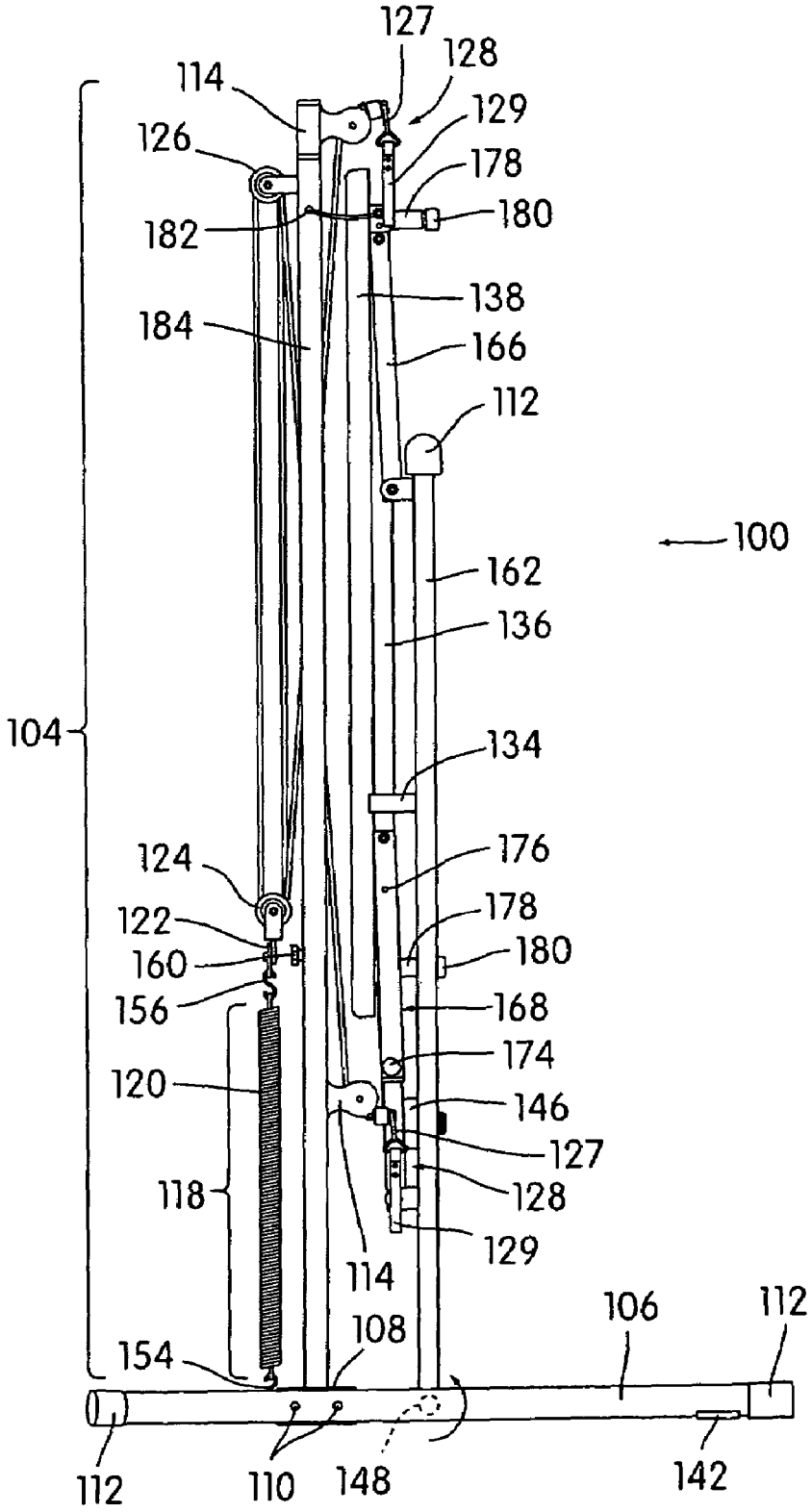
FIG. 8 is a side elevational view of the exercise apparatus of FIG. 1 in the connected storage position.

In FIG. 8, a pin 182 which hangs from the forward end of the bench has been inserted into a hole formed in one of the vertical members 184 of the tower 104. When so inserted, the pin 182 retains the exercise apparatus 100 in the connected storage position by retaining the bench apparatus 130 in its vertical position.

Figure 9:
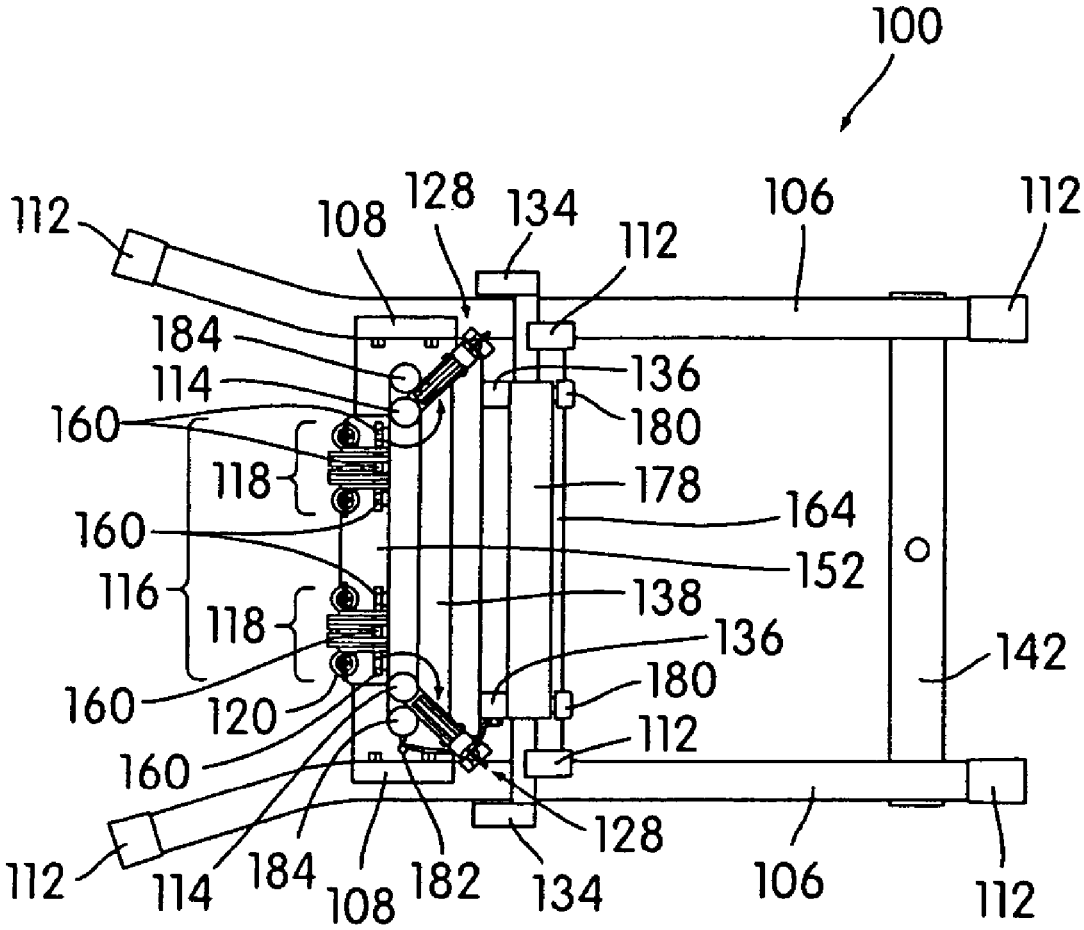
FIG. 9 is a top plan view of the exercise apparatus of FIG. 1 in the connected storage position.

FIG. 9 is a top plan view of the exercise apparatus 100 in its connected storage position. As is shown in this Figure, the bench assembly 130 extends vertically, abutting the tower 104. FIG. 9 also clearly illustrates the reduced space requirements of the apparatus 100 in the connected storage position—only the tubular members 106 extend beyond the tower 104. The tubular members 106 are connected by the crossbrace 142.

Figure 10:
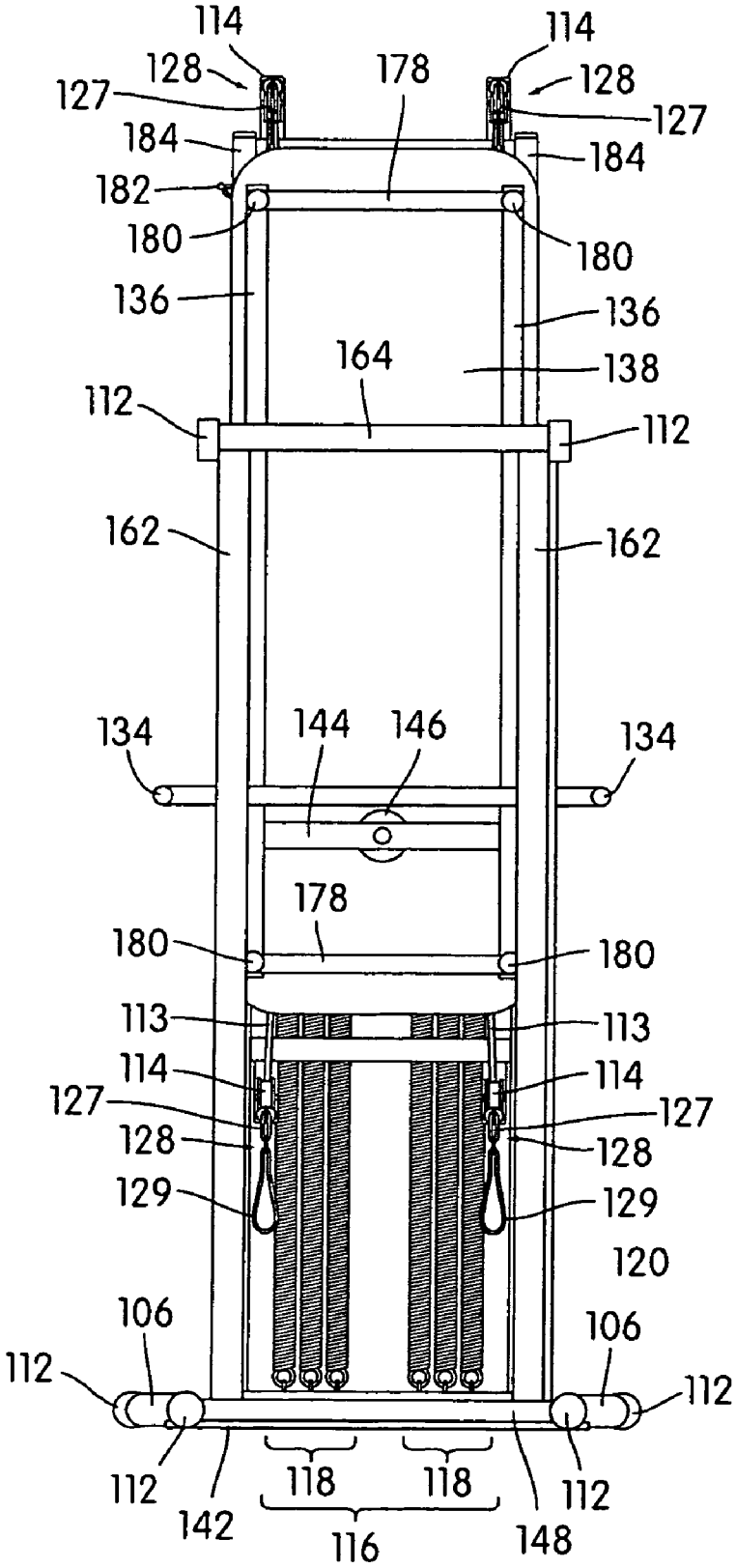
FIG. 10 is a front elevational view of the exercise apparatus of FIG. 1 in the connected storage position.

FIG. 10 is a front elevational view of the apparatus 100 in the connected storage position. The underside of the bench 136 is visible, along with the rectangular members 178, and the rubber feet 180. As is shown in FIG. 10, the knob and threaded rod 146 may be retained in the corresponding crossmember 144.

Figure 11:
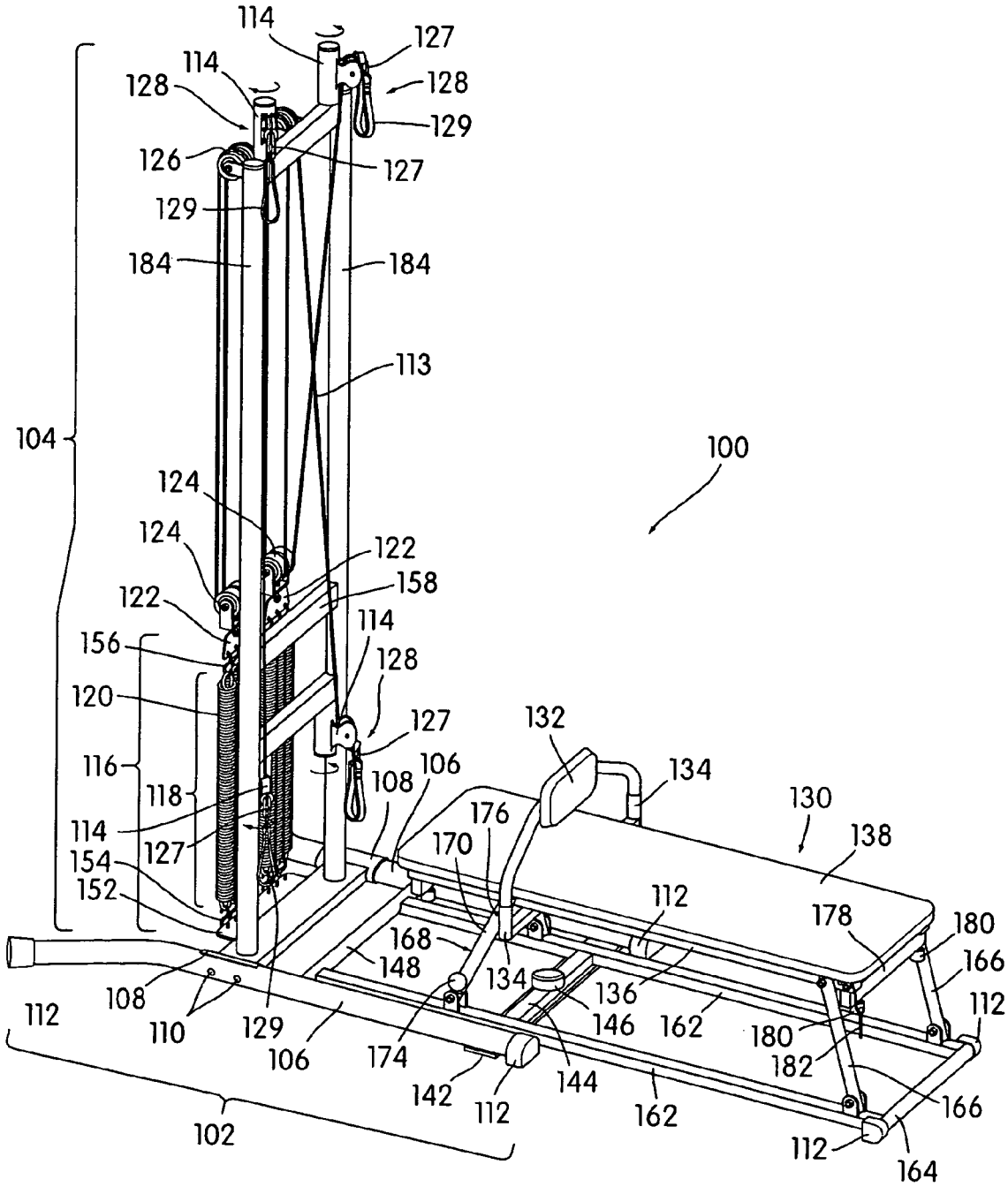
FIG. 11 is a perspective view of the exercise apparatus of FIG. 1 illustrating the range of motion of the swiveling directional pulley assemblies.

The exercise apparatus 100 can provide resistive bias in an arbitrary plurality of planes to support exercise motions. The ability to provide resistive bias in an arbitrary plurality of planes is provided by the swiveling directional pulley assemblies 114 on the upper and lower portions of the tower 104. As a user pulls one of the grip assemblies 128 attached to the pull lines 112 in an arbitrary direction, the corresponding directional pulley assembly 114 swivels, thus providing resistance in that plane (i.e., that line of motion). FIGS. 9 and 11 illustrate the range of motion of the swiveling directional pulley assemblies 114.

FIGS. 12–20 illustrate certain exemplary exercises that may be performed using the exercise apparatus 100. A user, generally indicated in these Figures by the letter P, may pull either of the upper or lower grip assemblies 128 with either arms or legs in any direction within the range of motion of the swiveling directional pulley assemblies 114. Depending on the particular exercise as well as the user's preferences, the chest/back support 132 may be installed in the receptacle 134 to assist the user P in achieving proper posture or positioning. If the rotor assemblies 200 are installed, the user P may actuate one of these with either a hand or a foot, and may also hold one of the grip assemblies 128 with that hand or foot while using the rotor assembly 200, thus providing additional resistive bias for the circular movements supported by the rotor assemblies 200.

Figure 12:
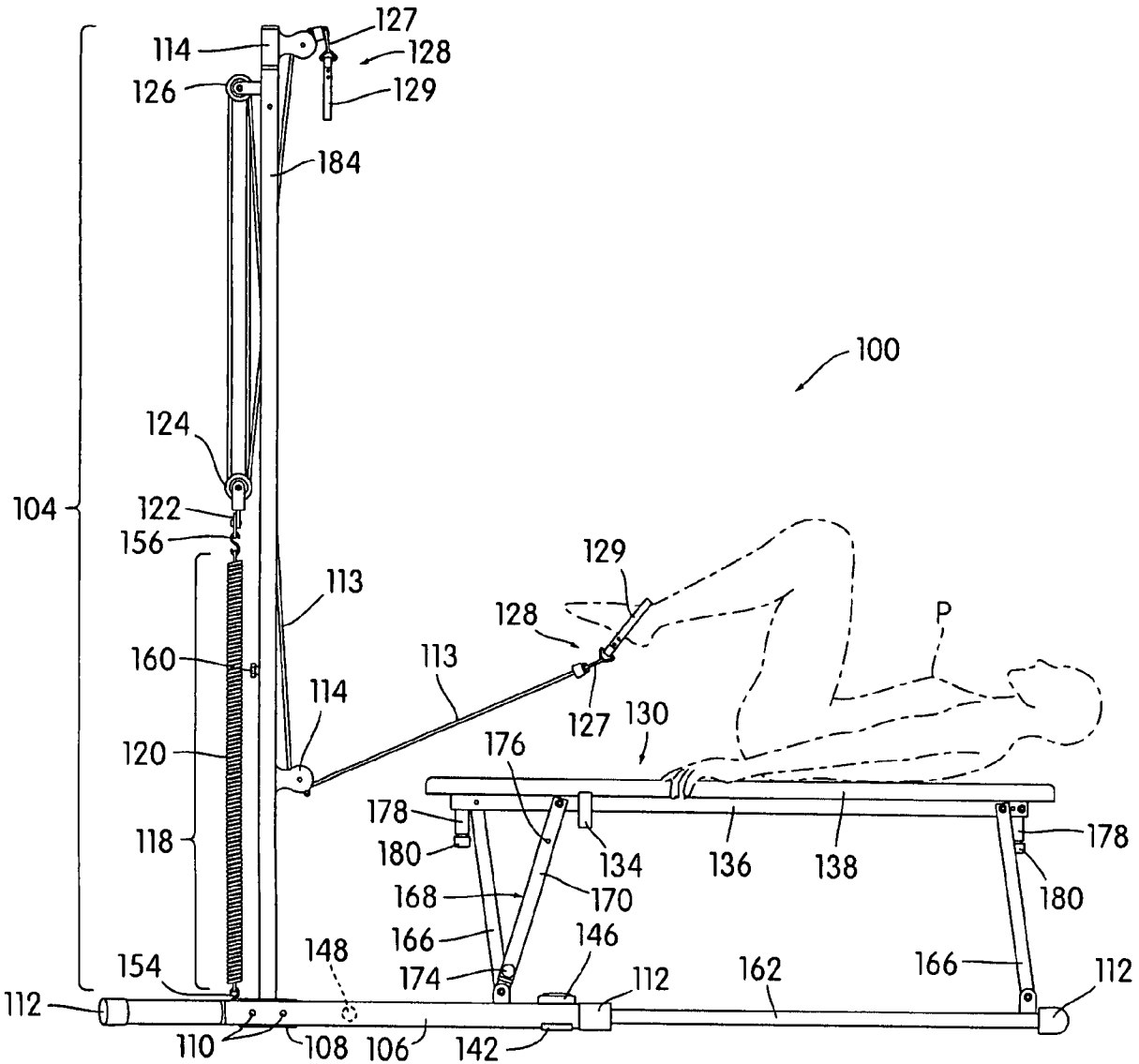
FIGS. 12–20 are various views illustrating the exercise apparatus of FIG. 1 in use.

In FIG. 12, the user P is depicted in a partially supine position, pulling the lower grip assemblies 128 with his or her feet. Following the position shown, the user P may either directly return to a fully supine position, allowing the pull line 113 and grip assembly 128 to retract, or he or she may pull the feet up into a vertical position before returning to the fully supine position.

Figure 13:
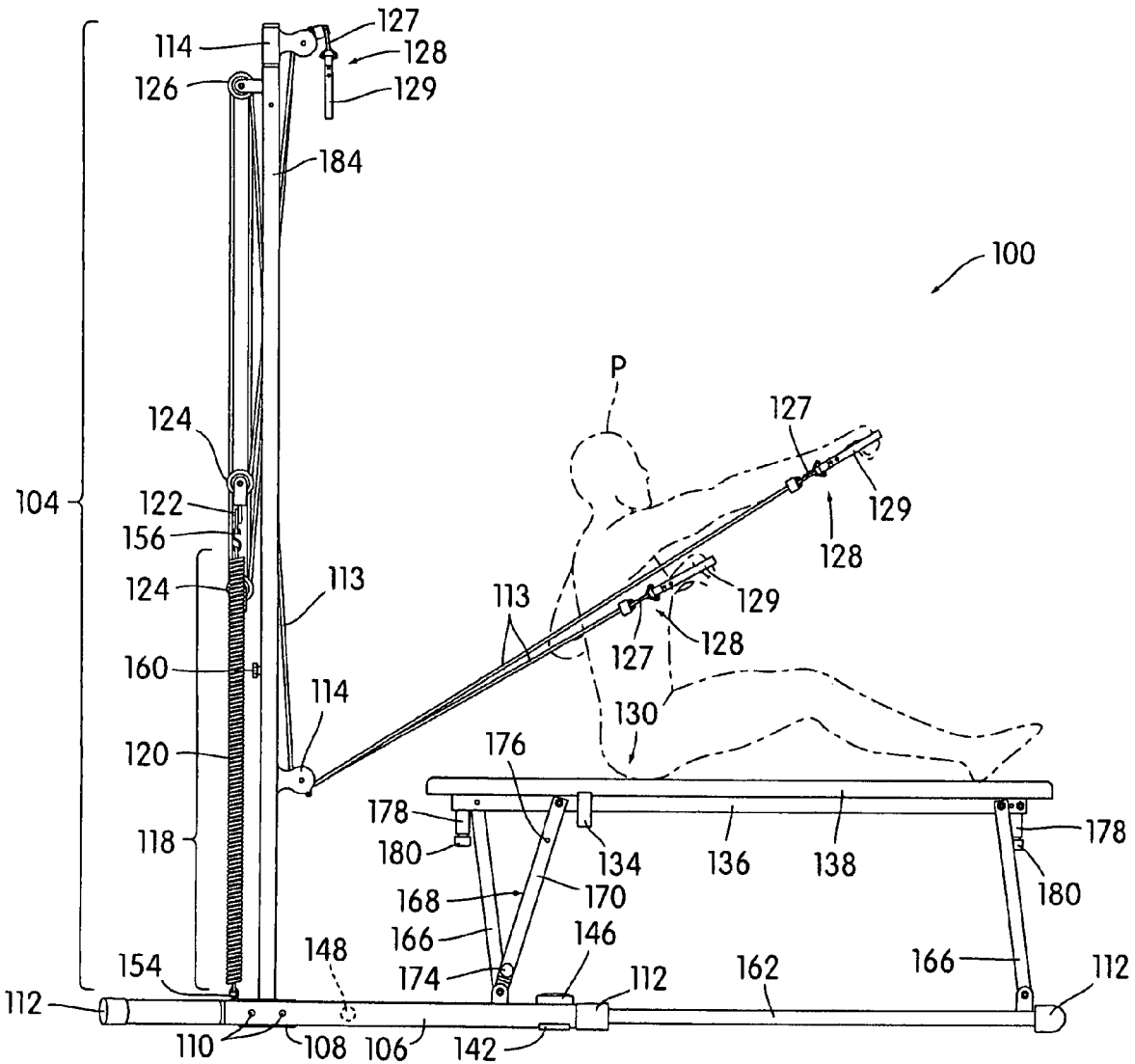

FIG. 13 shows the user P in a sitting position, facing away from the tower 104. In this exercise, the user P pulls the lower grip assemblies 128 with the hands, making thrusting motions with the arms. The chest/back support 132 (not shown in FIG. 13) may be installed for this exercise. Note that the movement of the user's arms is not coincidental in this exercise. Consequently, the movement of the grips 128 and pull lines 113 is not coincidental, and therefore, the movement of the two spring sub-assemblies 118 is not coincidental. (In FIG. 13, the springs 120 of the two sub-assemblies have different extended lengths, and therefore, the first pulley sets 124 of the sub-assemblies 118 are shown at different heights.) The independent movement of each spring sub-assembly 118 allows the user P to perform the illustrated exercise at a rate and resistance level appropriate for each arm.

Figure 14:
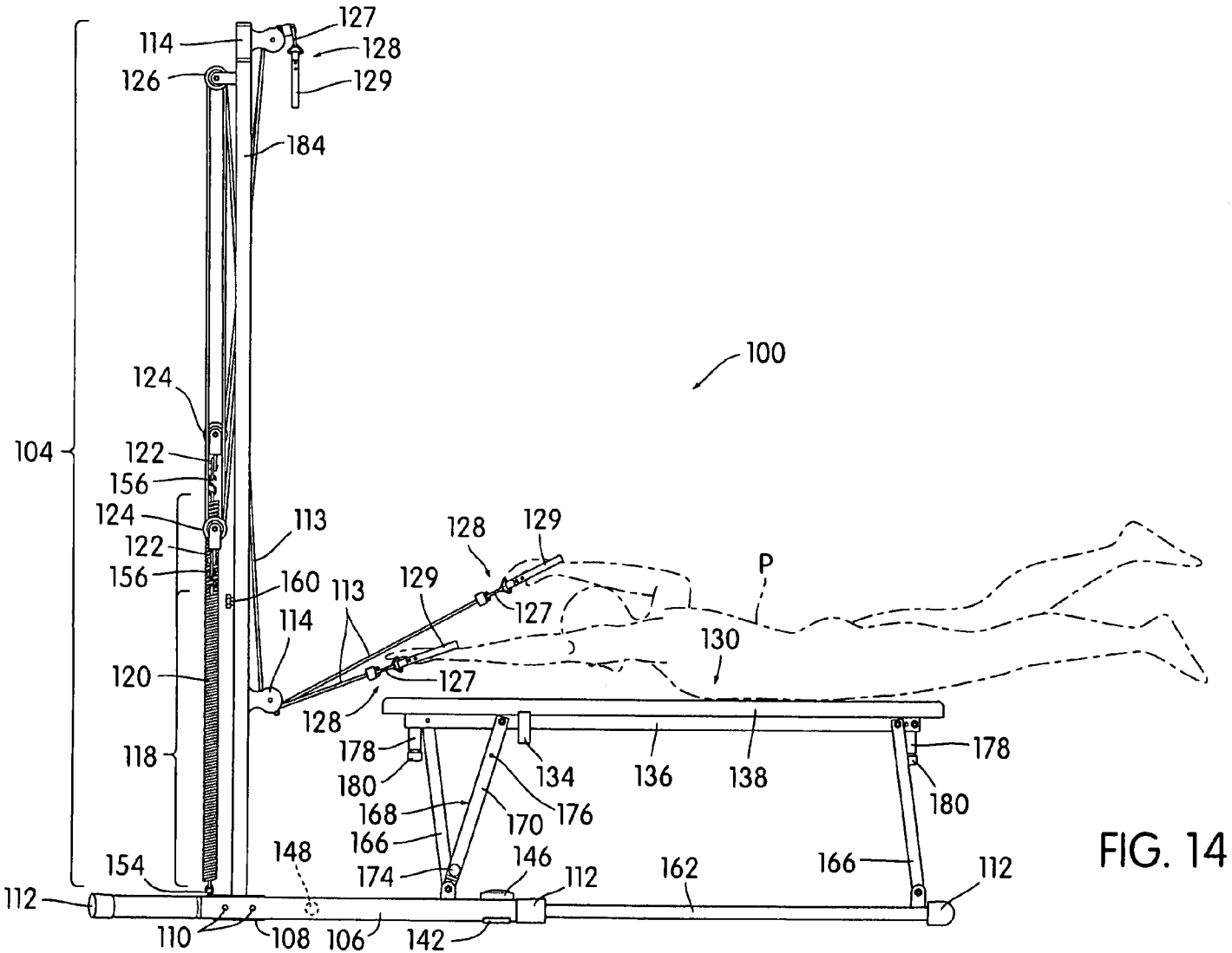

FIG. 14 shows the user P lying in a prone position on the bench pad 138, gripping the lower grip assemblies 128 with the hands. The exercise illustrated in FIG. 14 involves swim-like motions—the user P makes circular, overhand motions with the arms while concurrently "kicking" the legs. As in the exercise of FIG. 13, the motions of the arms are not concurrent, and consequently, the two spring sub-assemblies 118 have different extended lengths.

Figure 15:
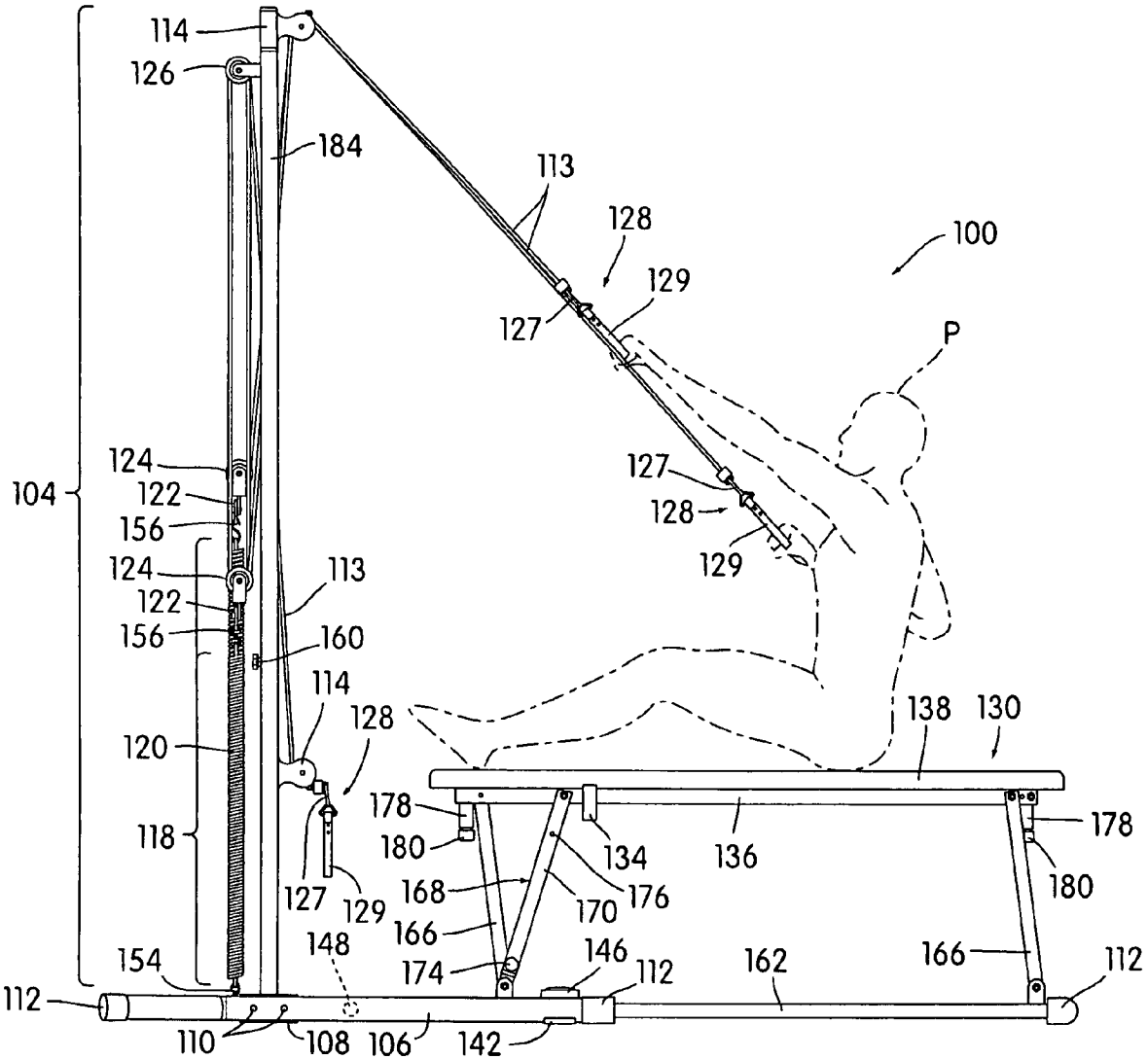

In FIG. 15, the user P is shown performing an exercise somewhat similar to the exercise illustrated in FIG. 13. As shown in FIG. 15, the user P is facing the tower 104 and gripping the upper grip assemblies 128 with the hands. The illustrated exercise also involves thrusting motions of the arms, but the use of the upper grip assemblies forces the user P to exercise the arms in a different line-of-motion, thereby placing different forces upon the muscles of the arms.

Figure 16:
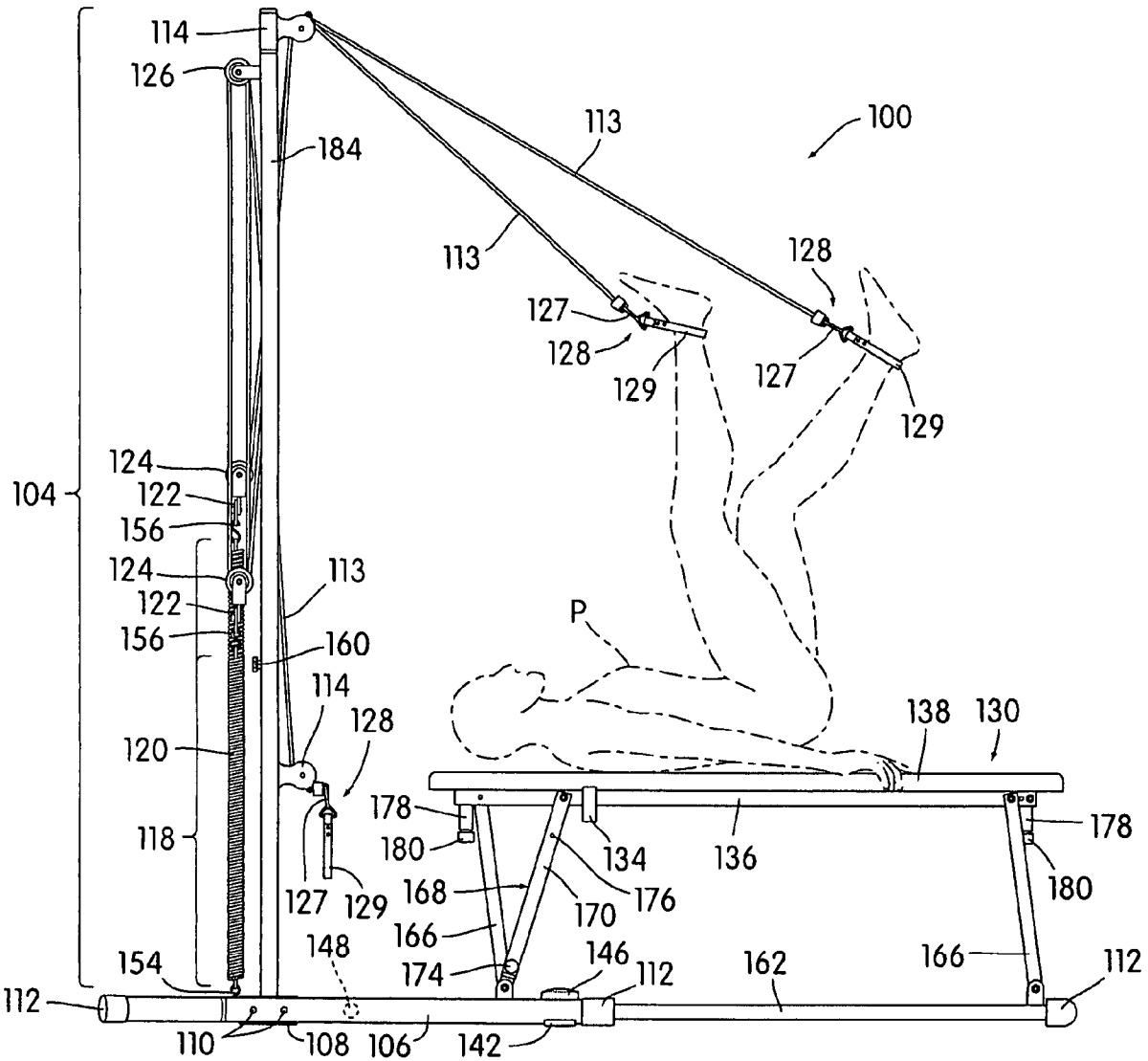

In the exercise illustrated in FIG. 16, the user P lies on the bench pad 38 with his or her head towards the tower 104 and pulls the upper grip assemblies 128 with his or her feet, making circular "bicycling" movements with the feet.

Figure 17:
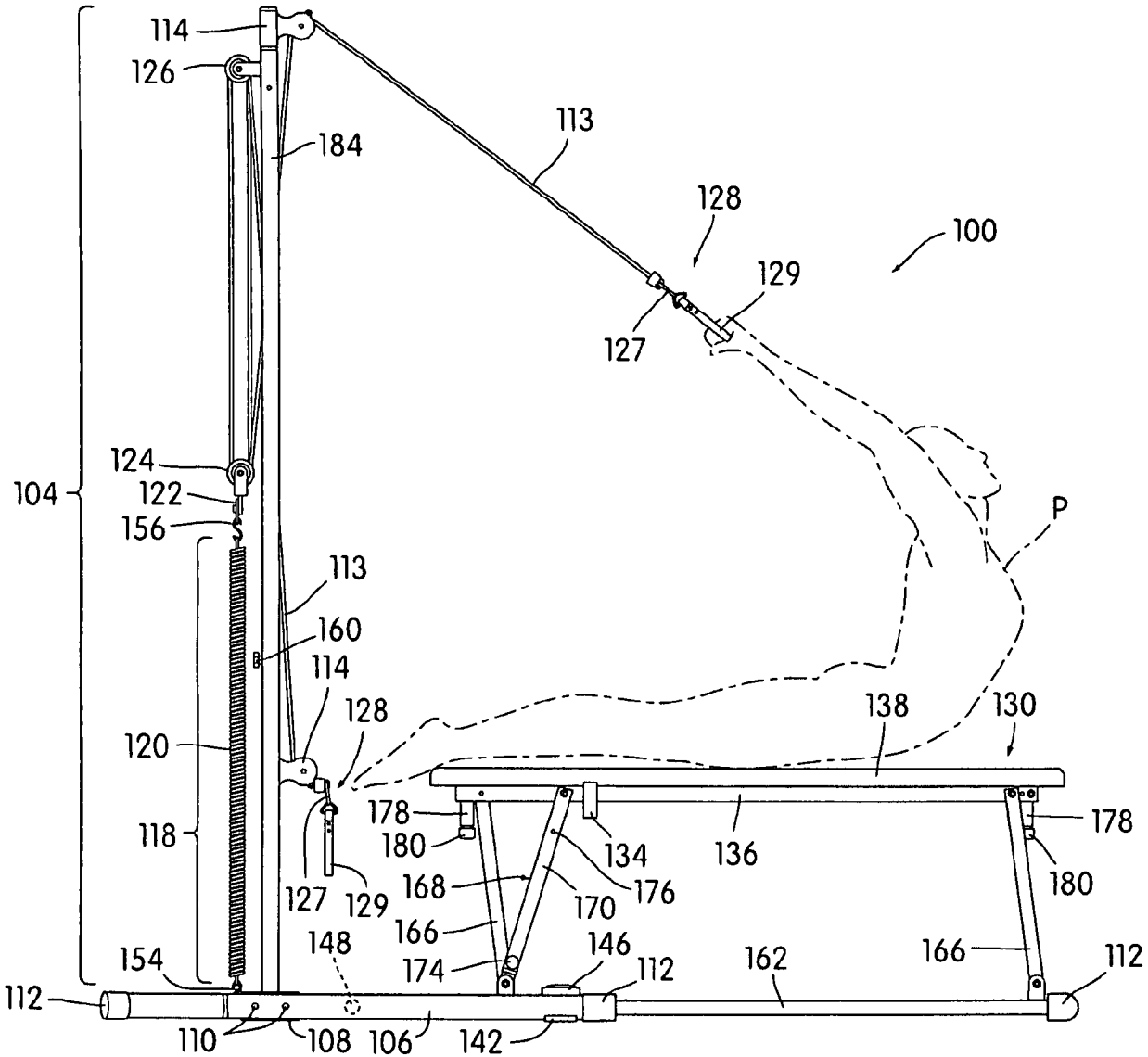

In FIG. 17, the user P is performing a resistively-biased version of the yoga "cobra stretch." The user P lies in generally prone position on the bench pad 138 with his or her head facing away from the tower 104, and extends his or her arms towards the tower 104, gripping the grip assemblies 128 with the hands.

Figure 18:
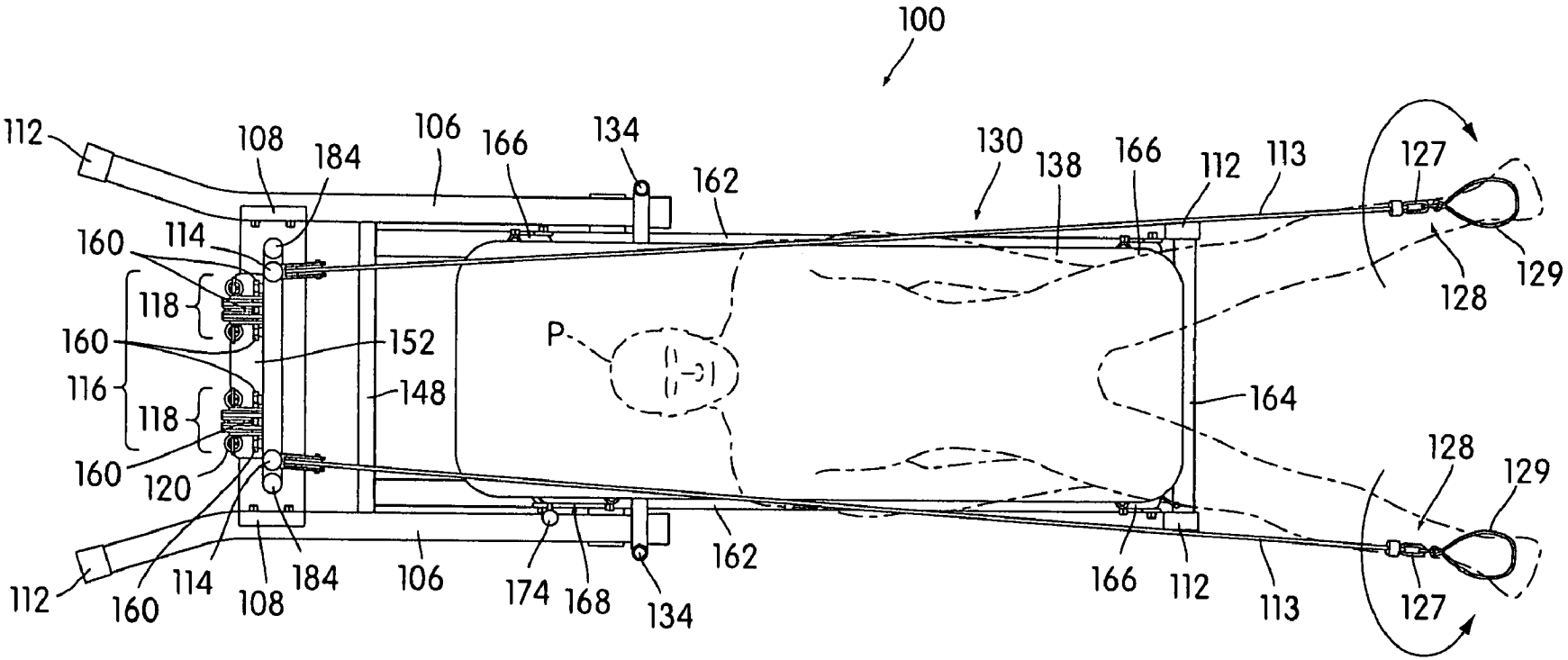

FIG. 18 illustrates the user P lying supine on the bench pad 38 and performing leg exercises using the upper set of grip assemblies 128. The user P's legs are elevated above the bench pad 138, and he or she makes circular motions from the hip.

Figure 19:
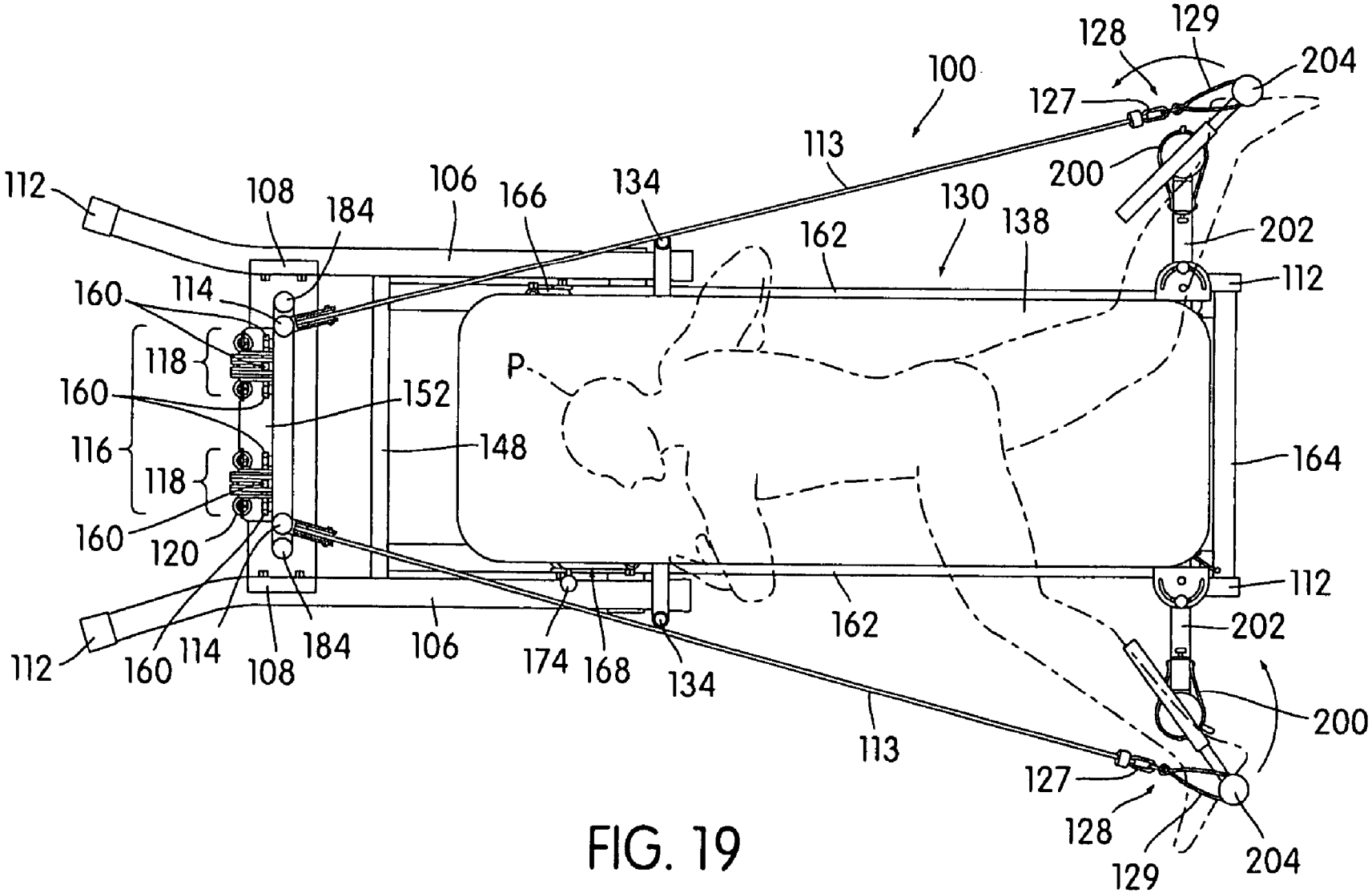

In the exercise shown in FIG. 19, the user P lies essentially prone on the bench pad 138 and rotates the handles 204 of the rotor assemblies 200 with his or her feet. The upper grip assemblies 128 have been attached to the handles of the rotor assemblies 204 (i.e., looped over the rotor assembly handles 204) to provide the user P with additional resistive bias as the rotor assemblies 200 are rotated. This configuration of the upper grip assemblies 128 and the rotor assemblies 200 may also be used for a variety of exercises in which the user P rotates the rotor assemblies 200 with the hands; if the user P performs rotor exercises with the hands, he or she may either hold the grip assemblies 128 or attach them to the handles 204 of the rotor assemblies 200 (as is illustrated in FIG. 19).

Figure 20:
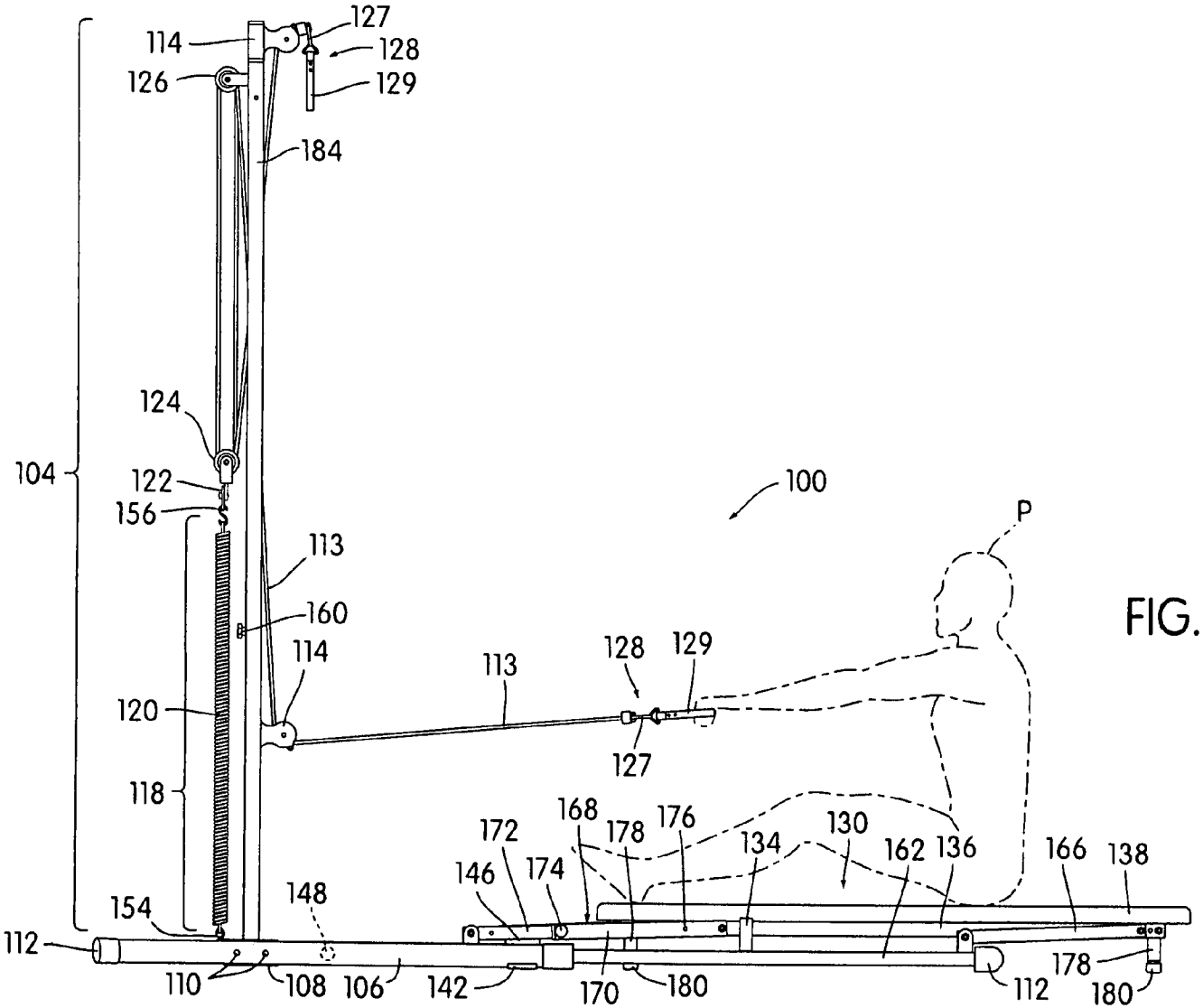

FIG. 20 shows the exercise apparatus 100 in use with the bench assembly 130 in the lower operative position. In the exercise of FIG. 20, the user P pulls the lower grip assemblies 128 with his or her hands. The exercise illustrated in FIG. 20 is only one of a number of exercises that may be performed with the bench assembly 130 in the lower operative position; one advantage of the lower operative position is that it provides the user P with a padded surface for floor-based exercises.

Figure 21:
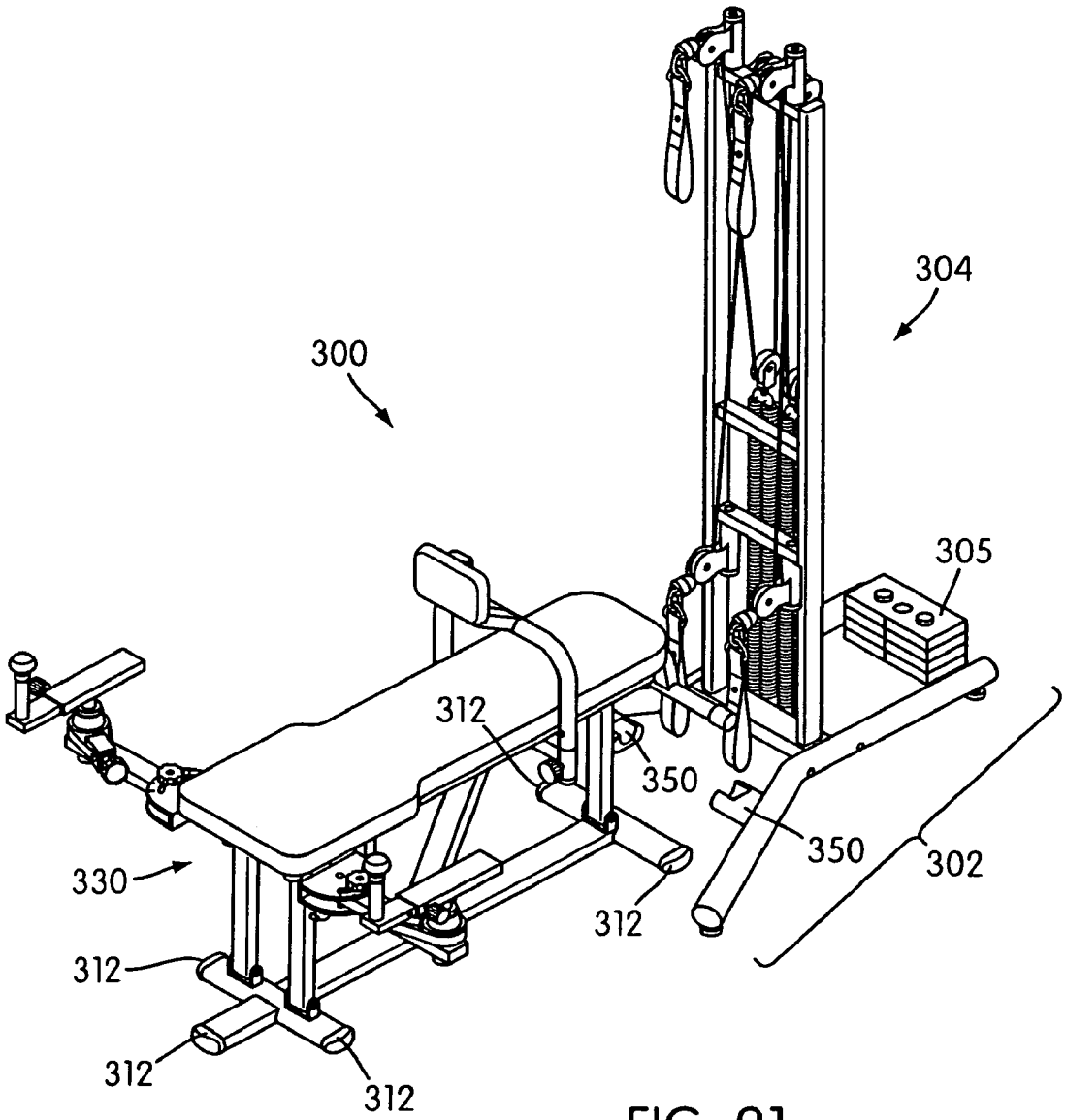
FIG. 21 is a perspective view of an exercise apparatus according to a second embodiment of the present invention.

FIG. 21 is a perspective view of an exercise apparatus 300 according to a second embodiment of the present invention. In the exercise apparatus 300, the tower structure 304 and bench assembly 330 are constructed and arranged to be used while disconnected from one another. To prevent the tower 304 from tipping while in use, a set of weight plates 305 is mounted between the tubular members 306 rearward of the tower structure 304.

Although the tower structure 304 and bench assembly 330 are constructed and arranged to be used while disconnected from one another, the exercise apparatus 300 may be placed in raised and lowered operative positions and a connected storage position similar to that of the apparatus 100. In order to hold the bench assembly 330 in the connected storage position, the base structure 302 of the apparatus 300 includes two tubular cradle members 350, one tubular cradle member 350 attached to each of the tubular members 306 and projecting inwardly therefrom. The connected storage position of the exercise apparatus 300 will be discussed in more detail below. With the exception of the weight plates 305 and tubular cradle members 350, the tower structure 304 of the exercise apparatus 300 is identical to the tower structure 104 of the exercise apparatus 100, therefore, the discussion presented above with respect to the tower structure 104 will suffice to describe the tower structure 304.

Figure 22:
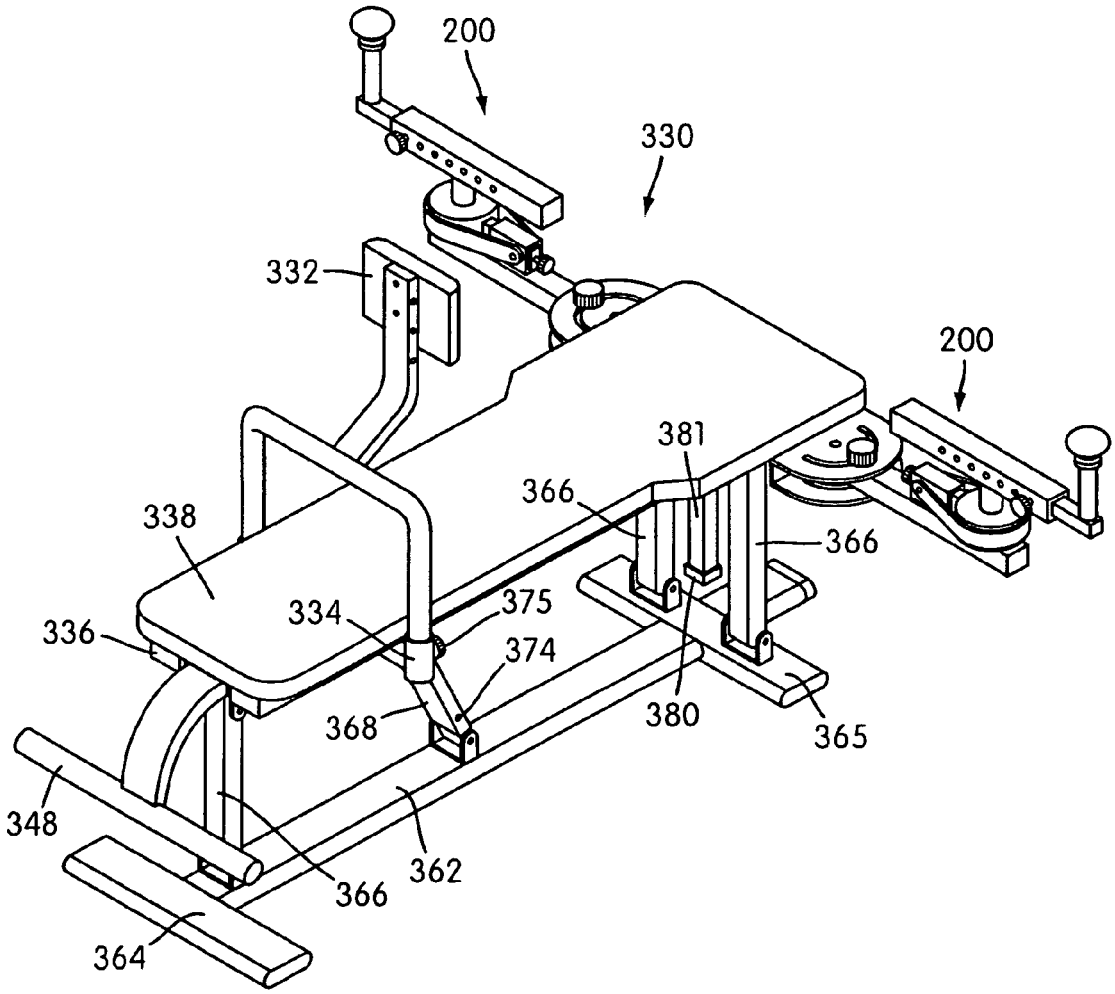
FIG. 22 is a perspective view of the bench assembly of the exercise apparatus of FIG. 21 in a raised operative position.

FIG. 22 is a perspective view of the bench assembly 330 in its raised operative position. The bench assembly 330 is similar to bench assembly 130 in that it comprises a bench pad 338 and bench 336 connected to a floor contact member 362 by means of legs 366. The bench assembly 330 also includes an extendable and retractable fourth leg 368 which is used as a locking mechanism to retain the bench 336 in the raised and lowered operative positions, respectively.

In bench assembly 330, a single, central floor contact member 362 is provided, extending in a direction parallel to that of the bench 336 proximate to floor level. Two crosspieces 364, 365 are fixedly connected to and extend in a direction perpendicular to the central floor contact member 362. One crosspiece 364 is fixedly connected to one of the terminal ends of the central floor contact member 362; the other crosspiece 365 is fixedly connected to the central floor contact member 362 just adjacent to the other terminal end of the central floor contact member 362. The ends of the crosspieces 364, 365 and the central floor contact member 362 are each provided with rubberized endcaps 312 to prevent slipping. Two legs 366 are pivotally mounted on the crosspiece 365 for rotation between the central floor contact member 362 and the bench 336, one leg 366 on each side of the central floor contact member 362. A third leg 366 is pivotally mounted between the central floor contact member 362 and the bench frame 336 at the opposite end of the central floor contact member 362. The extendable and retractable fourth leg 368 is pivotally mounted for rotation between the bench 336 and the central floor contact member 362. As in the bench assembly 130, the bench assembly 330 cannot be moved between the raised and lowered operative positions unless the length of the extendable and retractable fourth leg 368 is changed. The fourth leg 368 is held in position by a pin 374 inserted through holes through the members of the leg.

Figure 23:
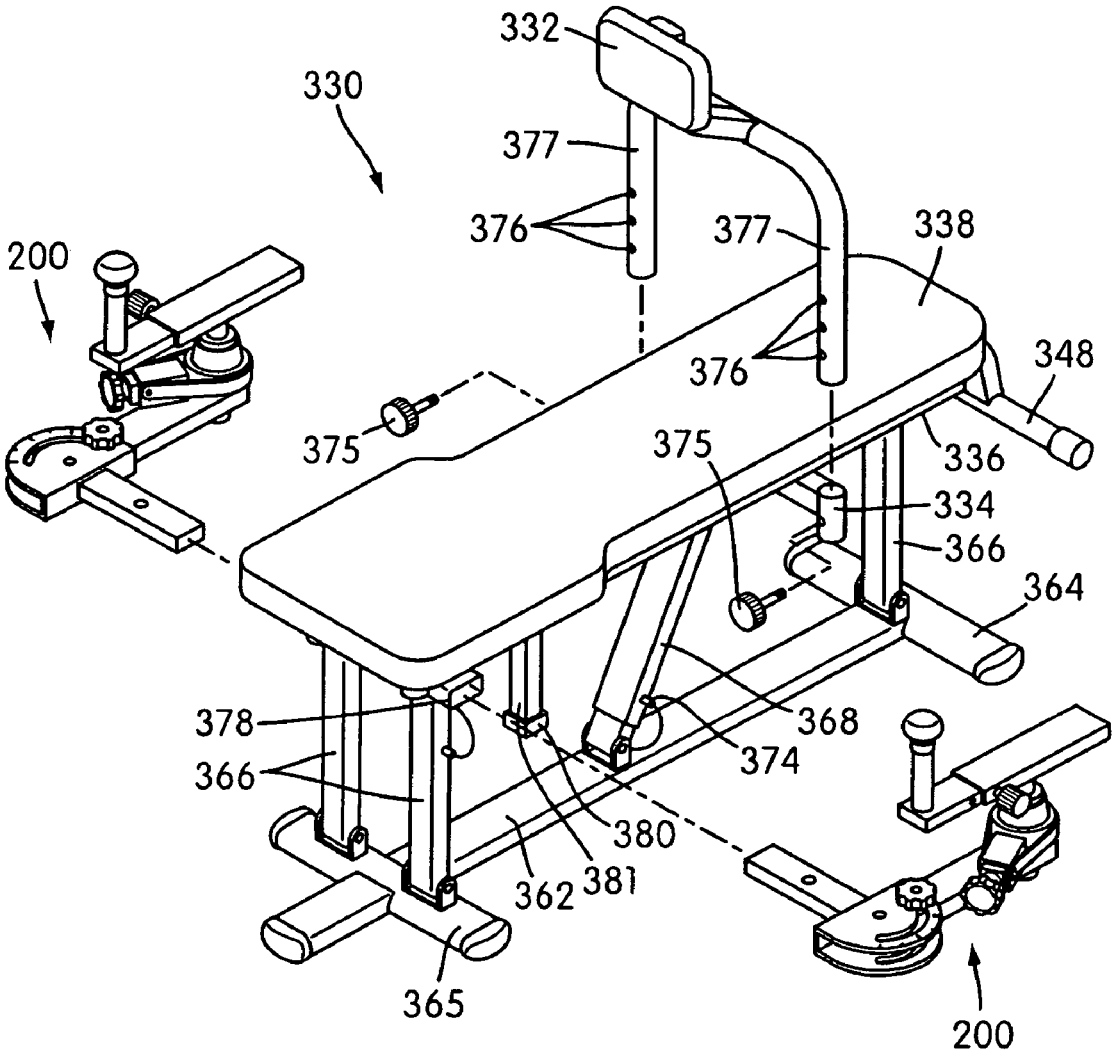
FIG. 23 is an exploded perspective view of the bench assembly of FIG. 21 in a raised operative position, illustrating the attachment of accessories.

FIG. 23 is an exploded perspective view of the bench assembly 330 in its raised operative position, illustrating the attachment of the rotor assemblies 200 and the removable chest and back support 332. As shown, the connecting arm of the rotor assemblies 200 inserts into the tubular, hollow rectangular member 378 at the forward end of the bench assembly 330. As in bench assembly 130, the tubular, hollow rectangular member 378 is fixedly attached to the underside of the bench 336, and may be provided with endcaps for use if the rotors 200 are not installed. In the bench assembly 330, rubber feet 380 are not installed on the tubular, hollow rectangular member; rather, they are installed on a separate tubular post 381 which projects downwardly from the underside of the bench 336.

In bench assembly 330, the removable chest and back support 332 mates with a pair of receptacles 334. The removable chest and back support 332 is of adjustable height in this second embodiment; it has a number of holes 376 drilled along the lengths of its tubular members 377 and a pair of pins 375 are inserted into the holes 376 to hold the removable chest and back support at a particular height.

As shown in FIGS. 22 and 23, the bench assembly 330 also includes a hanging crossbar 348 which fits into the tubular cradle members 350 of the tower structure 304 when the bench assembly is placed into either the lower operative or the connected storage positions. To establish the connected storage position of the apparatus 300, the user places the bench assembly 330 in the lower operative position with the hanging crossbar 348 inserted into the tubular cradle members 350 and then rotates the bench assembly 330 about the hanging crossbar 348 until the bench assembly 330 extends vertically, in parallel with the tower 304.

Figure 24:
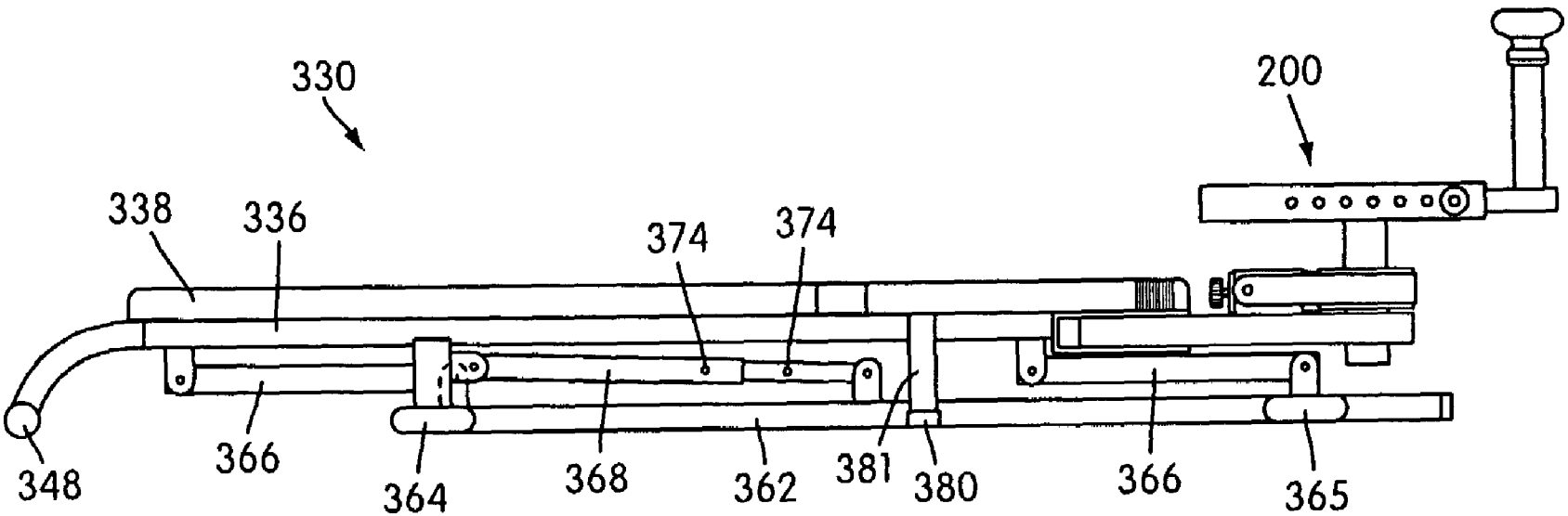
FIG. 24 is a side elevational view of the bench assembly in a collapsed position.
Figure 25:
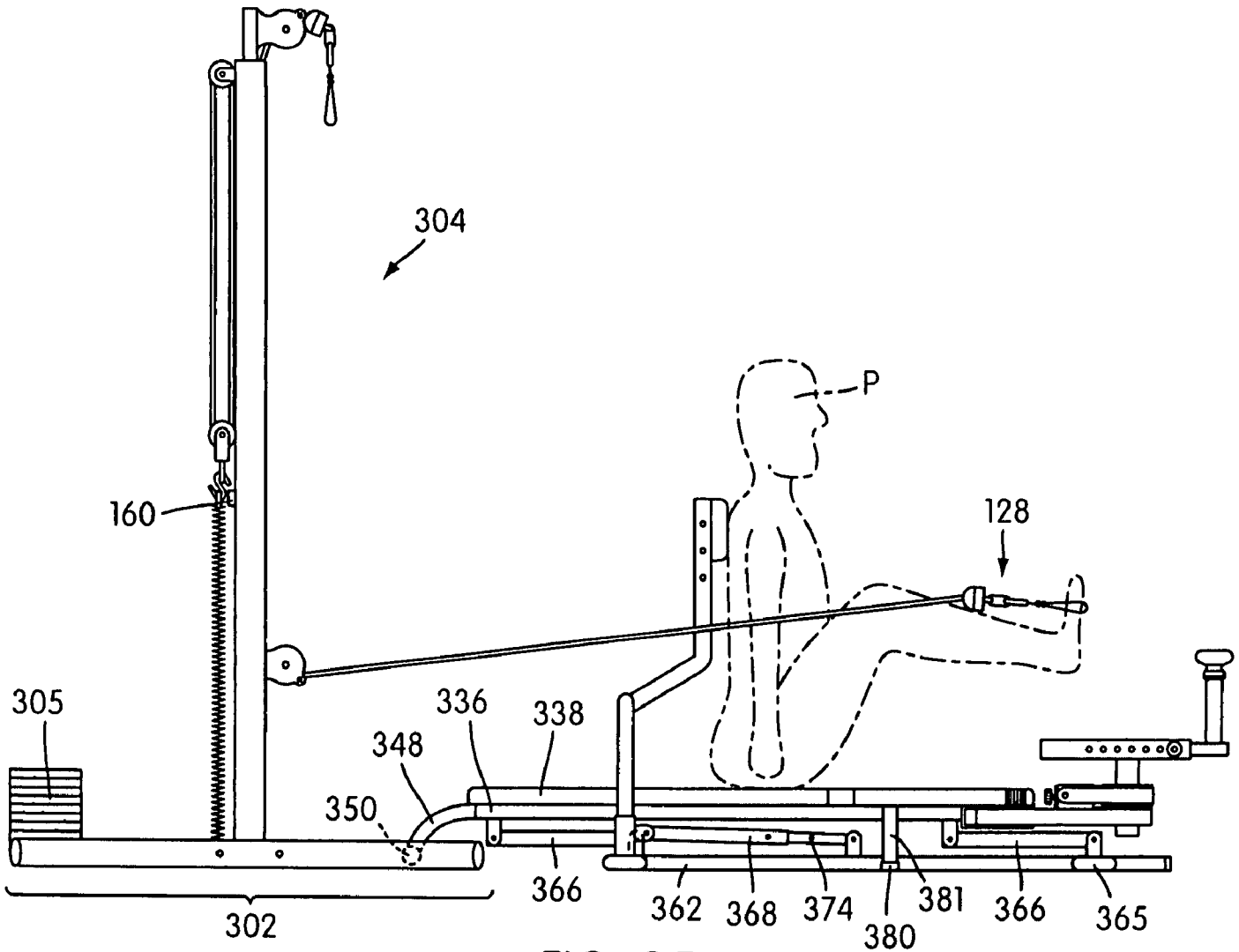
FIG. 25 is a side elevational view of the exercise apparatus of FIG. 21, illustrating a lower operative position.

FIG. 24 is a side elevational view of the bench assembly in a collapsed position. Note that the hanging crossbar projects from the underside of the bench 336 such that it is proximate to floor level. FIG. 25 is a side elevational view illustrating the lower operative position of the exercise apparatus 300. In FIG. 25, a user P is facing away from the tower structure 304 with the removable chest and back rest 332 installed and pulling the lower grip assemblies 128 using the legs.

Figure 26:
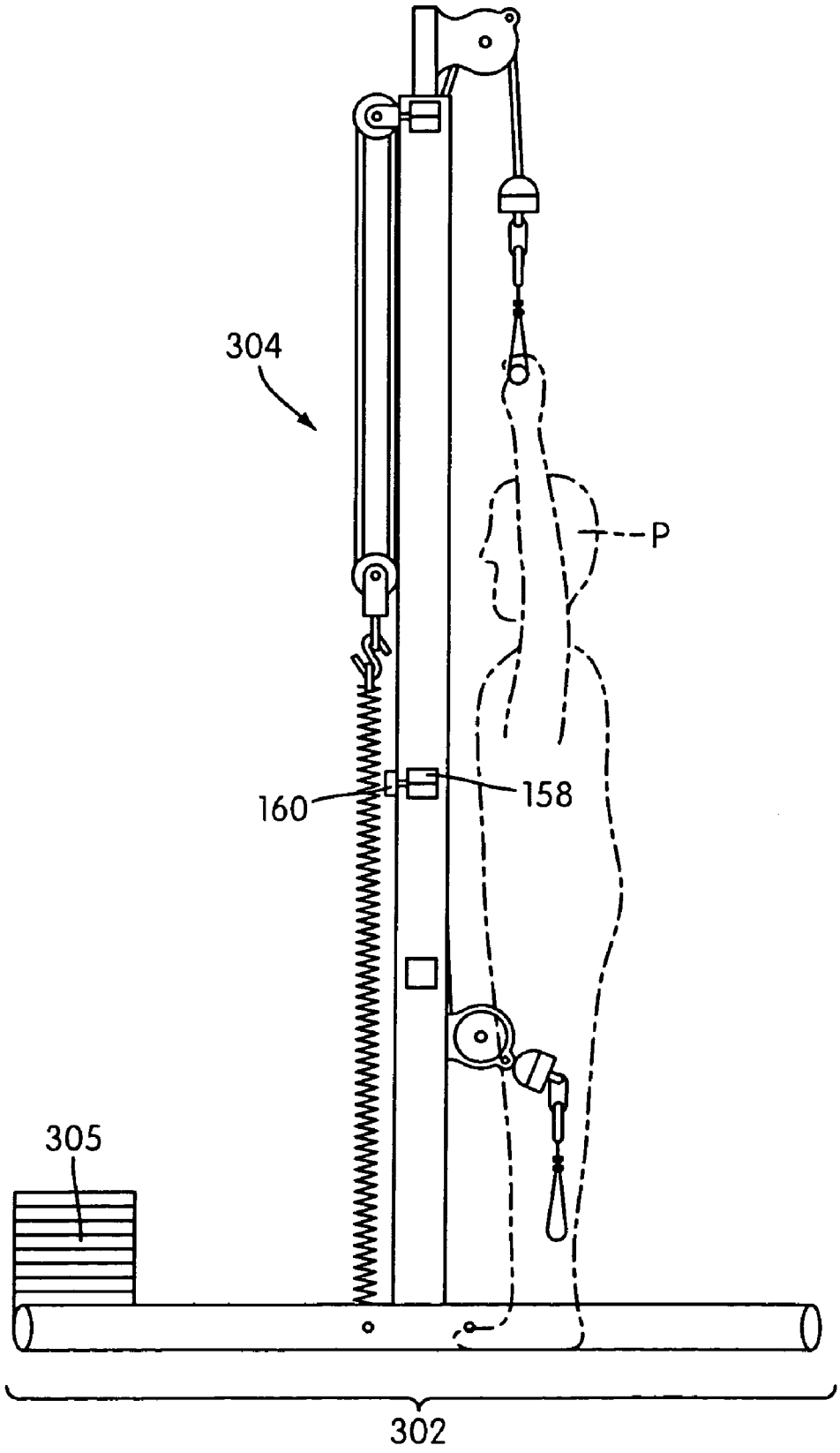
FIG. 26 is a side elevational view of the tower structure of the exercise apparatus of FIG. 21 without the bench assembly.

FIG. 26 is a side elevational view of the tower structure 304 without the bench assembly 330. One particular advantage of the second embodiment of the present invention is that the user P may perform exercises using only the tower structure 304, without the bench assembly 330. As illustrated in FIG. 26, this is particularly advantageous for exercises (arm exercises, in FIG. 26) that require the user P to be close to the tower.

Figure 27:
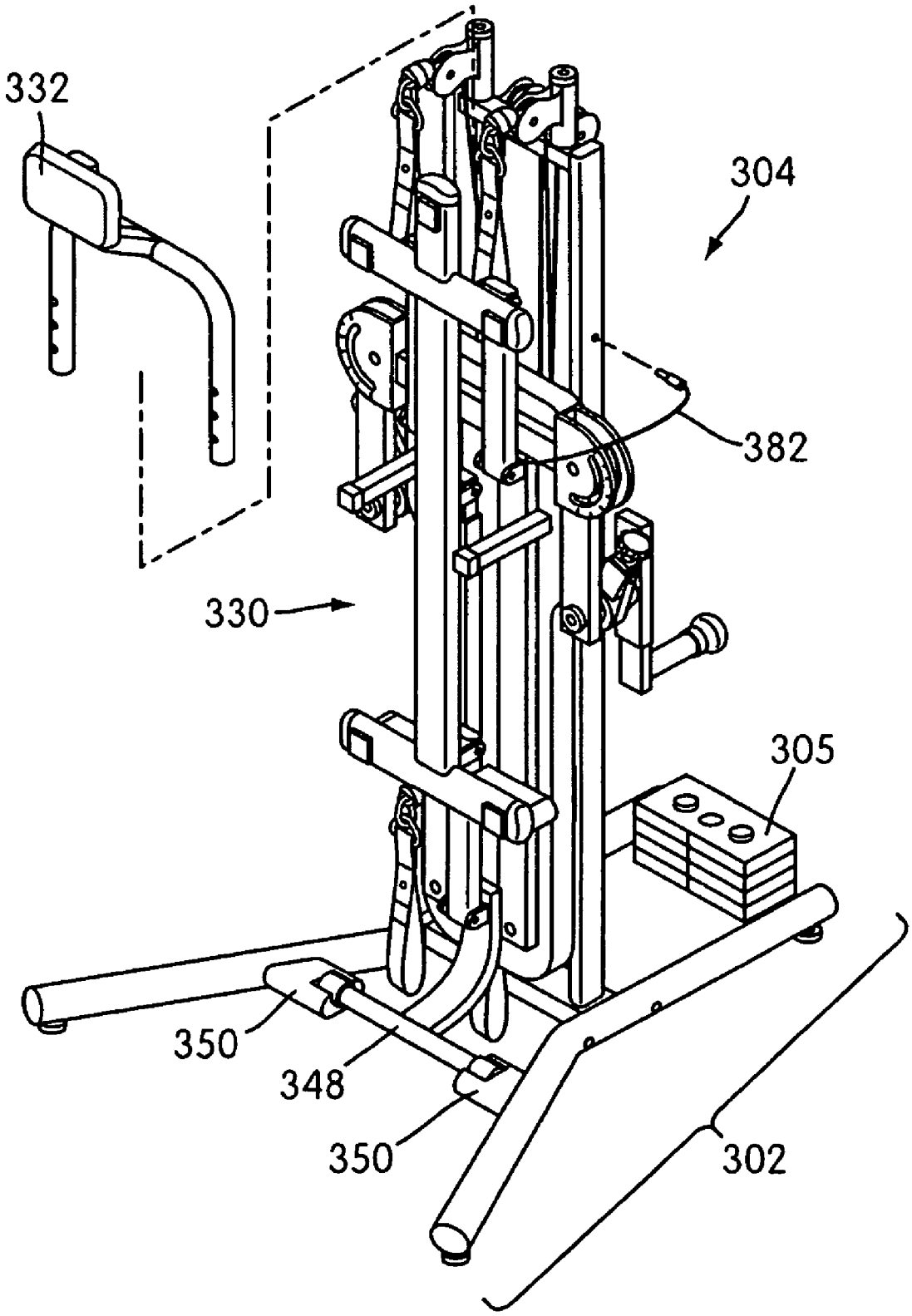
FIG. 27 is a perspective view of the exercise apparatus of FIG. 21 in a connected storage position.

FIG. 27 is a perspective view of the apparatus 300 in the connected storage position. In this position, the hanging crossbar 348 rests within the tubular cradle members 350, while the collapsed bench assembly 330 extends in parallel to the tower 304. The handles 204 of the rotor assemblies 200 have been rotated so that they also extend in parallel to the tower 304. As shown in FIG. 27, a pin 382 is used to retain the apparatus 300 in the connected storage position.

It will thus be seen that the objects of this invention have been fully and effectively accomplished. It will be realized, however, that the foregoing preferred specific embodiments have been shown and described for the purpose of illustrating the functional and structural principles of this invention and are subject to change without departure from such principles. Therefore, this invention includes all modifications encompassed within the spirit of the following claims.

What is claimed is:

1. An exerciser, comprising:

a frame assembly including a base structure and an upright structure fixed to said base structure and extending upwardly therefrom, said base structure having downwardly facing surfaces for engaging a horizontal surface in supported relation thereon and being structured and arranged such that said exerciser is freestanding on the horizontal surface; an exercising mechanism carried by said frame assembly;

upper user interconnecting structures coupled to said exercising mechanism and being selectively extensible by an exercise of a user from an operative position at an upper end portion of said upright structure;

lower user interconnecting structures coupled to said exercising mechanism and being selectively extensible by an exercise of a user from an operative position at a lower portion of said upright structure;

said exercising mechanism being structured and arranged to resilient resist the movement of the upper and lower user interconnecting structures away from said exercising mechanism; and a bench assembly being removably and pivotally coupled to said frame assembly such that said bench assembly may be removed from said frame assembly and be pivotally attached to said frame assembly, said bench assembly being selectively pivoted to said frame assembly at a pivot end of said bench assembly so that said bench assembly may be moved between an operable position wherein the user may utilize said bench assembly for support, and a stored, upright position wherein a free end of said bench assembly that is opposite to said pivot end is adjacent to said upright structure, wherein said bench assembly has a user supporting surface and a bench assembly support coupled to and extending from said user supporting surface, said bench assembly support being pivotably movable from a retracted position adjacent said user supporting surface and an extended position for supporting said bench assembly above the horizontal surface and also removing said bench assembly from said frame assembly.

2. An exerciser according to claim 1, wherein said exercising mechanism includes a plurality of coil springs.

* * * * *